US010422165B2

(12) United States Patent
Engibarov et al.

(10) Patent No.: US 10,422,165 B2
(45) Date of Patent: Sep. 24, 2019

(54) TAMPER-RESISTANT LOCK

(71) Applicant: ENGBAR INC., Las Vegas, NV (US)

(72) Inventors: Eddy Engibarov, Las Vegas, NV (US); Larrie Thomas, Las Vegas, NV (US); Dontcho Denkov, Las Vegas, NV (US)

(73) Assignee: ENGBAR INC., Las Vegas, NV (US)

( * ) Notice: Subject to any disclaimer, the term of this patent is extended or adjusted under 35 U.S.C. 154(b) by 0 days.

(21) Appl. No.: 16/127,428

(22) Filed: Sep. 11, 2018

(65) Prior Publication Data

US 2019/0017293 A1 Jan. 17, 2019

Related U.S. Application Data

(63) Continuation of application No. 15/699,617, filed on Sep. 8, 2017, now Pat. No. 10,100,557.
(Continued)

(51) Int. Cl.
*E05B 67/24* (2006.01)
*E05B 17/20* (2006.01)
(Continued)

(52) U.S. Cl.
CPC ..... *E05B 67/24* (2013.01); *E05B 17/2088* (2013.01); *E05B 35/008* (2013.01); *E05B 65/0089* (2013.01); *E05B 67/063* (2013.01); *E05C 5/04* (2013.01); *E05B 15/024* (2013.01); *E05B 15/10* (2013.01); *E05B 47/0045* (2013.01)

(58) Field of Classification Search
CPC .... E05B 67/24; E05B 17/2088; E05B 67/063; E05B 15/10; E05B 35/008; E05B 5/04; E05B 65/0089; E05B 47/0045; E05B 15/024; E05B 47/0038; B25B 23/0021; B25B 23/0035; F16B 41/005; F16B 23/007
USPC ... 70/63, 158–173, 229–232, 461, 403, 404, 70/140, DIG. 57, 276, 413; 81/177.85, 81/442–444, 446, 448; 292/251, 252, 292/256, 256.5, DIG. 30, 340, 341, 292/341.18, 341.19, 251.5; 411/410, 910,
(Continued)

(56) References Cited

U.S. PATENT DOCUMENTS 294,524 A * 3/1884 Stiemke
3,859,826 A * 1/1975 Singer ..... E05B 73/0005 70/371

(Continued)

*Primary Examiner* — Lloyd A Gall
(74) *Attorney, Agent, or Firm* — Workman Nydegger

(57) ABSTRACT

A locking system includes a tamper-resistant lock and key. The tamper-resistant lock includes a cylindrical lock body with external threading on at least a portion thereof and a bore extending into an end of the cylindrical lock body. The bore includes an engagement feature disposed on the wall that defines the bore, and the engagement feature is disposed a particular distance away from the bore opening. The key includes a collar that has a cylindrical key body that fits within the bore of the cylindrical lock body. The cylindrical key body also includes an opening defined by the collar sidewall, a retractable engagement member at least partially disposed within the opening, a spring disposed within the collar, and a plunger disposed within the collar that is operable to engage the spring and has a recess sized and shaped to accommodate the retractable engagement member.

19 Claims, 16 Drawing Sheets

Related U.S. Application Data

(60) Provisional application No. 62/522,459, filed on Jun. 20, 2017.

(51) Int. Cl.

| | |
|---|---|
| ***E05B 67/06*** | (2006.01) |
| ***E05B 35/00*** | (2006.01) |
| ***E05B 65/00*** | (2006.01) |
| ***E05C 5/04*** | (2006.01) |
| *E05B 15/10* | (2006.01) |
| *E05B 47/00* | (2006.01) |
| *E05B 15/02* | (2006.01) |

(58) Field of Classification Search
USPC ..... 411/403, 407, 104, 348, 372.5, 372.6, 411/271, 325, 954, 60.2
See application file for complete search history.

(56) References Cited

U.S. PATENT DOCUMENTS 4,044,647 A * 8/1977 Takahashi ..... F16B 13/08 411/39
4,710,082 A * 12/1987 Curtis ..... F16B 41/005 285/89
5,603,472 A * 2/1997 Hutter, III ..... B64C 1/12 244/132
6,006,631 A * 12/1999 Miner ..... B25B 23/0035 81/177.85
6,302,630 B1 * 10/2001 Grant ..... A47G 3/00 411/372.6
6,378,405 B1 * 4/2002 Miller ..... B25B 13/485 81/176.15
6,641,343 B1 * 11/2003 Duran ..... F16B 19/109 411/348
9,188,149 B2 * 11/2015 Bennett ..... F16B 41/005
10,100,557 B1 * 10/2018 Engibarov ..... E05B 67/24
2010/0054854 A1 * 3/2010 Wang ..... B25B 15/001 403/322.2
2011/0056340 A1 * 3/2011 Hsu ..... B25B 13/06 81/437
2013/0333528 A1 * 12/2013 Su ..... B25B 23/0007 81/177.2
2015/0000625 A1 * 1/2015 Newman ..... F02M 35/104 123/184.21

* cited by examiner

TAMPER-RESISTANT LOCK

CROSS-REFERENCE TO RELATED APPLICATIONS

This application is a continuation of U.S. patent application Ser. No. 15/699,617, filed Sep. 8, 2017 and titled "TAMPER-RESISTANT LOCK", now U.S. Pat. No. 10,100,557, which claims priority to and the benefit of U.S. Provisional Patent Application Ser. No. 62/522,459, filed Jun. 20, 2017 and titled "UNIVERSAL THOMAS LOCK," the disclosure of which is incorporated herein by this reference in its entirety.

BACKGROUND

Technical Field

This disclosure generally relates to locking systems. Particularly, this disclosure relates to systems that include a tamper-resistant lock and components for securing the same.

Related Technology

There are many items that people want to keep safe or which are desired to be kept free from interference or tampering by others. In many instances these items are sealed with a container or behind a barrier using a lock, and only individuals with the appropriate key can access the contents sealed behind the lock. However, many locks can be picked or easily circumvented.

Accordingly, there are a number of disadvantages with locking systems that can be addressed.

BRIEF SUMMARY

Implementations of the present disclosure solve one or more of the foregoing or other problems in the art with locking systems. In particular, one or more implementations can include a tamper-resistant lock and a key. The tamper-resistant lock includes a cylindrical lock body having external threading on at least a portion of a length of the cylindrical lock body and a bore extending into an end of the cylindrical lock body. The bore has an engagement feature disposed on a wall defining the bore with the engagement feature being disposed a particular distance away from an opening of the bore. The key includes a collar having a cylindrical key body sized and shaped to be at least partially disposed within the bore, an opening defined by a sidewall of the collar, a retractable engagement member at least partially disposed within the opening defined by the sidewall of the collar, a spring disposed within the collar, and a plunger disposed within the collar operable to engage the spring. The plunger has a recess that is sized and shaped to accommodate the retractable engagement member.

In an embodiment, a locking system includes an adjustable adaptor, a tamper-resistant lock, and a key. The adjustable adaptor is configured to be at least partially disposed within an interior portion of a housing and includes: a first end having a channel disposed therein, a lock coupling member sized and shaped to slidably fit within the channel, and a second end disposed opposite the first end and separated therefrom by an elongate member. The second end is adjustable to selectively increase or decrease a distance between the first end and the second end. The tamper-resistant lock includes a body having a lower end selectively engaged with the lock coupling member and a bore extending into the body, the bore having an engagement feature disposed on a wall defining the bore. The key includes a collar sized and shaped to be at least partially disposed within the bore, an opening defined by a sidewall of the collar, and a retractable engagement member at least partially disposed within the opening. The retractable engagement member is sized and shaped to interact with the engagement feature when the retractable engagement member is in an extended position.

In an embodiment, a locking system includes an adjustable adaptor, a tamper-resistant lock, and a key. The adjustable adaptor is configured to be at least partially disposed within an interior portion of a housing and includes a first end having a channel disposed therein, a lock coupling member sized and shaped to slidably fit within the channel, and a second end disposed opposite the first end and separated therefrom by an elongate member. The second end is adjustable along the elongate member to selectively lengthen the first and second ends of the adjustable adaptor such that the adjustable adaptor spans a length or a width of the housing. The adjustable adaptor additionally includes a selectively extendable ram that engages the housing sidewall to secure the adjustable adaptor within the housing. The first and second ends of the adjustable adaptor each include a flange that engages an interior ledge or upper rim of the housing when the adjustable adaptor spans the length or the width of the housing. The locking system also includes a tamper-resistant lock for securing a lid to the housing. The tamper-resistant lock has a cylindrical lock body with external threading on at least a portion of a length thereof. The threaded portion of the cylindrical lock body passes through the lid and is selectively received within the lock coupling member of the adjustable adaptor. The tamper-resistant lock additionally includes a bore extending into an end of the cylindrical lock body. The bore has an engagement feature disposed on a wall defining the bore with the engagement feature being disposed a particular distance away from an opening of the bore. The locking system additionally includes a key. The key includes a collar having a cylindrical key body sized and shaped to be at least partially disposed within the bore of the tamper-resistant lock, an opening defined by a sidewall of the collar, a retractable engagement member at least partially disposed within the opening, a spring disposed within the collar, and a plunger disposed within the collar operable to engage the spring. The plunger includes a recess that accommodates the retractable engagement member when the spring is compressed.

Accordingly, locking systems are disclosed.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments, and is not necessarily intended to limit the scope of the claimed invention.

Overview of Locking Systems

Many public utilities are having valuable components stolen or tampered with by unauthorized personnel. For example, copper wire is being pilfered from electrical light posts and/or from within electrical boxes mounted within sidewalks or otherwise existing in a public space. The thieves or other mischievous individuals access the desired materials using the same access points as technicians or other authorized personnel.

Problematically, many of the access points are sealed with traditional bolts having a hexagonal head, and a nefarious individual can use common tools to open these access points. For example, if an access point is sealed with traditional bolts, a properly sized (and likely generally available) wrench can be used to remove the sealing bolts and by doing so, grant the wrench-wielder access to the previously sealed access point. As an additional example, if the access point is sealed using a traditional lock, the lock can be cut away or easily picked. New locking systems are needed to address this problem.

Exemplary Locking Systems

Embodiments of the present disclosure enable a locking system (e.g., the Universal Thomas Lock) that is tamper resistant and difficult to pick, remove, or otherwise break without use of the proper key, and in some instances, without the appropriate knowledge of the stepwise disengagement of the locking system. These locking systems can be implemented de novo or as a retrofit to light posts, electrical boxes, or any other housing that would benefit from a more secure and/or tamper-resistant locking system.

Figure 1:
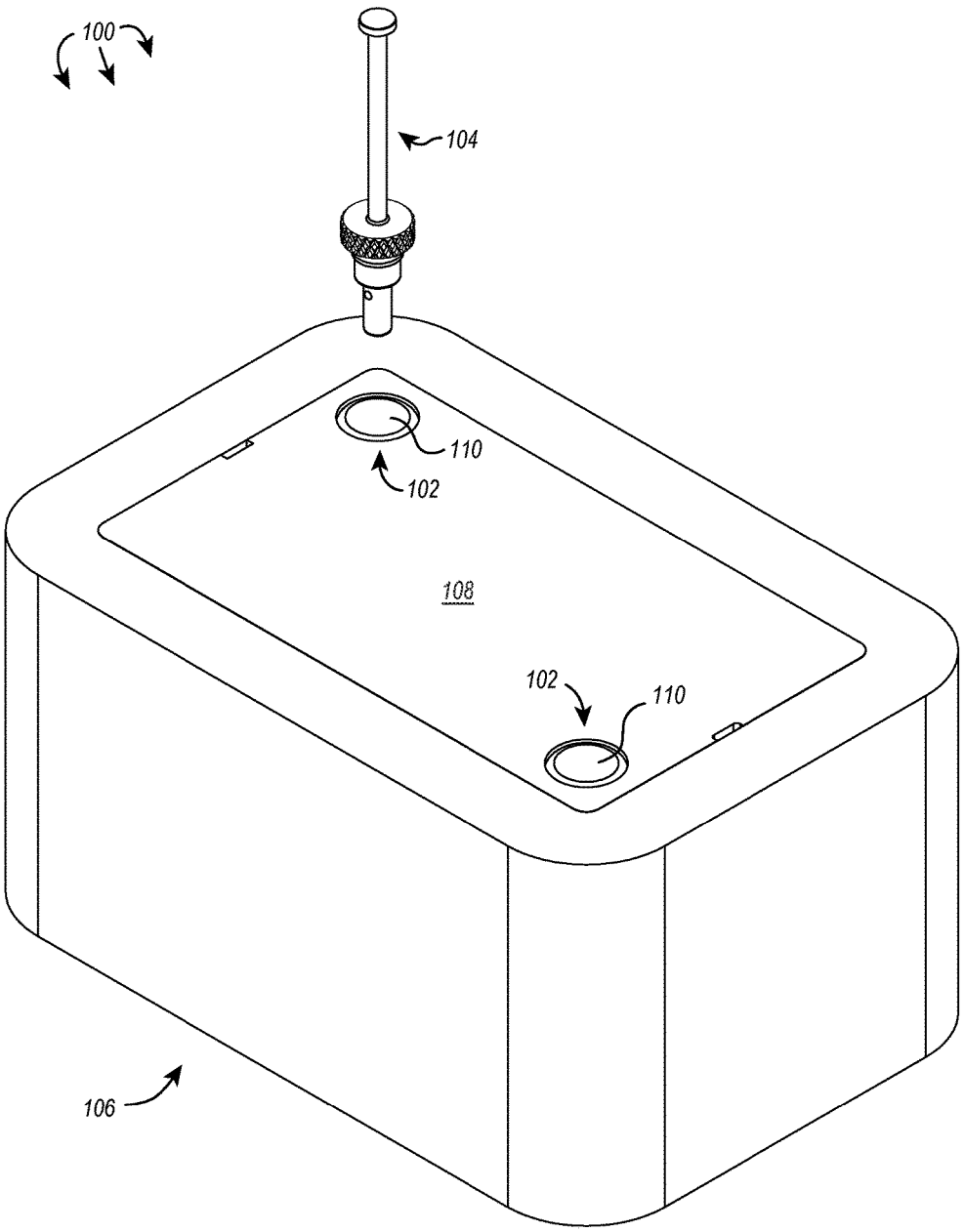
FIG. 1 illustrates a perspective view of an exemplary locking system.

FIGS. 1-4, for example, illustrate an exemplary locking system 100 of the present disclosure. As illustrated in FIG. 1, the locking system 100 includes two tamper-resistant locks 102 and a key 104. The two tamper-resistant locks 102 are engaging a housing 106 through the housing lid 108, thereby securing the lid 108 to the housing 106. In some embodiments, the housing 106 is an electrical box having electrical outlets, electrical components, conduits, access points, and/or meters. In some embodiments, the housing 106 is part of and/or in communication with a light post. In some embodiments, the housing 106 is a drop box, safe, or munitions container.

As can be seen in FIG. 1, each tamper-resistant lock 102 includes a bore cap 110, and each bore cap 110 is arcuate with a smooth top surface. In some embodiments, and as illustrated in FIG. 1, the bore cap 110 can be substantially circular. Due to the arcuate (or circular) nature of the bore cap 110, in addition to its smooth surface, there is a conspicuous lack of engagement surfaces for traditional tools. In other words, the bore cap 110 is not shaped to accommodate traditional crescent wrenches, and there are no grooves or patterns on the surface of the bore cap 110 that would allow a screwdriver or hex key (e.g., an Allen wrench) to grip, engage, or remove the cap. As such, the shaping and/or contour of the bore cap 110 can, in some embodiments, provide a first level of tamper resistance to the locking systems disclosed herein. To a casual observer or potential thief, there is no readily obvious way of removing the lock to open the lid as it appears to be riveted closed, fastened, or otherwise installed with a specialized tool.

Figure 2:
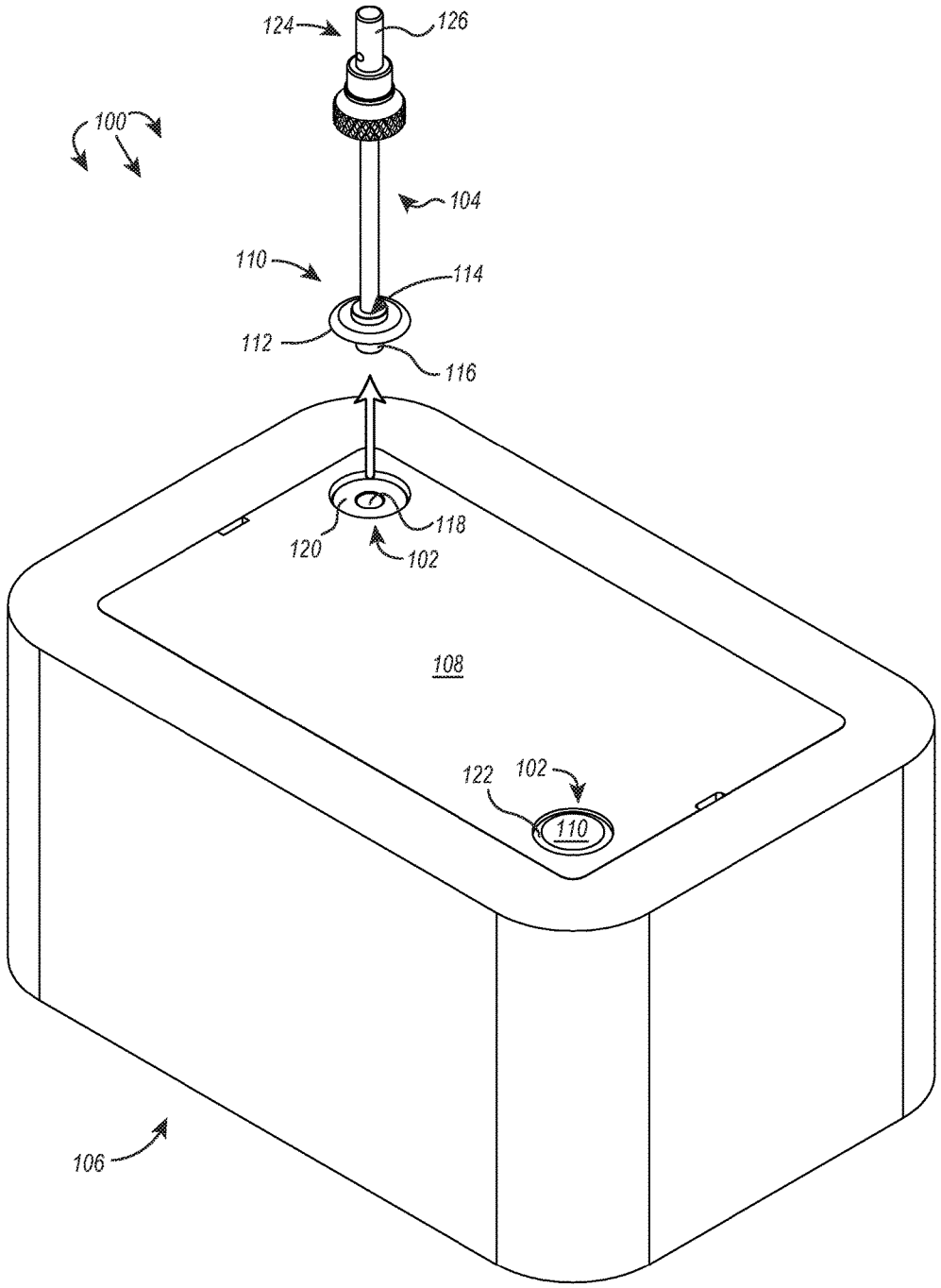
FIG. 2 illustrates a perspective view of the exemplary locking system of FIG. 1 with a cap removed, revealing the lock chamber.

In some embodiments, the bore cap 110 (or at least a head 112 thereof) is made of a ferrous material (e.g., iron, an iron alloy, or other magnetic material), and as shown in FIG. 2, the bore cap 110 can be engaged by and removed using a magnet 114. The magnet 114 is illustrated as part of the key 104, which is used in conjunction with the tamper-resistant lock 102. To remove the bore cap 110, the magnet 114 magnetically engages the head 112 of the bore cap 110, and the magnetic force between the head 112 and the magnet 114 is greater than the resistive force of the stem 116 on the sidewall that defines the bore 118. Accordingly, the magnet 114 gains and retains a hold of the bore cap 110, allowing it to draw the stem 116 away from the bore 118 to disassociate the bore cap 110 from the cylindrical lock body 120.

In some embodiments, the bore cap includes a magnetic undersurface (or is itself magnetic), and the bore cap is magnetically held to a top surface of an associated ferrous cylindrical lock body. The magnet of the key would, consequently, need to be a more powerful magnet such that it can overcome the magnetic force holding the bore cap to the cylindrical lock body.

In some embodiments, the bore cap includes or is made of a resilient material (e.g., non-ferrous metals or metal alloys, carbon fiber or glass reinforced composite materials, etc.), and the key includes a suction cup or vacuum that can be used to draw the bore cap from the bore of the cylindrical lock body.

In some embodiments, and as shown in FIGS. 1 and 2, the bore cap 110 includes a beveled edge 122 that is recessed below a surface of the lid 108 and that is in close proximity to a sidewall of the recess in the lid such that a prying tool cannot be leveraged underneath the beveled edge 122 to pry the bore cap 110 away from the cylindrical lock body 120.

In some embodiments, the bore cap 110, cylindrical lock body 120, or any other component of the tamper-resistant lock 102 and/or key 104 can be made from a hardened or strengthened material that resists drilling, concussive forces (e.g., hammer blows), slashing, tearing, or other destructive forces such as burning and low energy explosives. For example, the foregoing components can be made of hardened stainless steel. Thus, even at the superficial level of the bore cap 110, the tamper-resistant locks disclosed herein can be implemented to resist destructive tampering and prying, and there is beneficially (from the perspective of the lock owner) no obvious means of engaging the bore cap, which provides a first layer of defense against potential intrusive forces.

With continued reference to FIG. 2, once the bore cap 110 is removed, the top of the cylindrical lock body and the bore 118 become apparent. Similar to the bore cap 110, however, the top of the cylindrical lock body and the bore 118 appear, at least superficially, to be unremarkable. That is, these components are not shaped to receive and/or engage traditional tools such as a screwdriver or wrench.

Figure 3A:
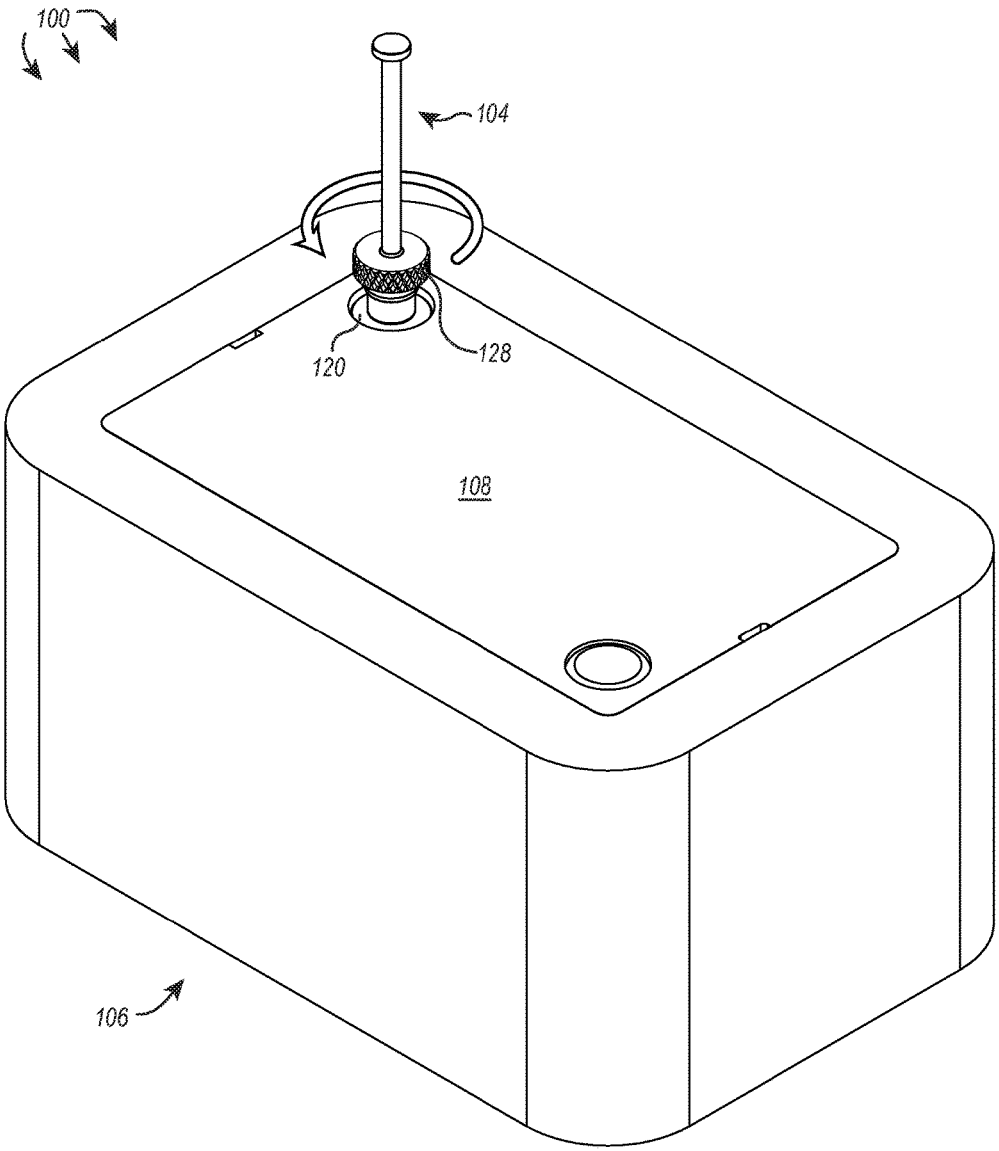
FIG. 3A illustrates a perspective view of the exemplary locking system of FIG. 2 with the key engaging the lock.
Figure 3B:
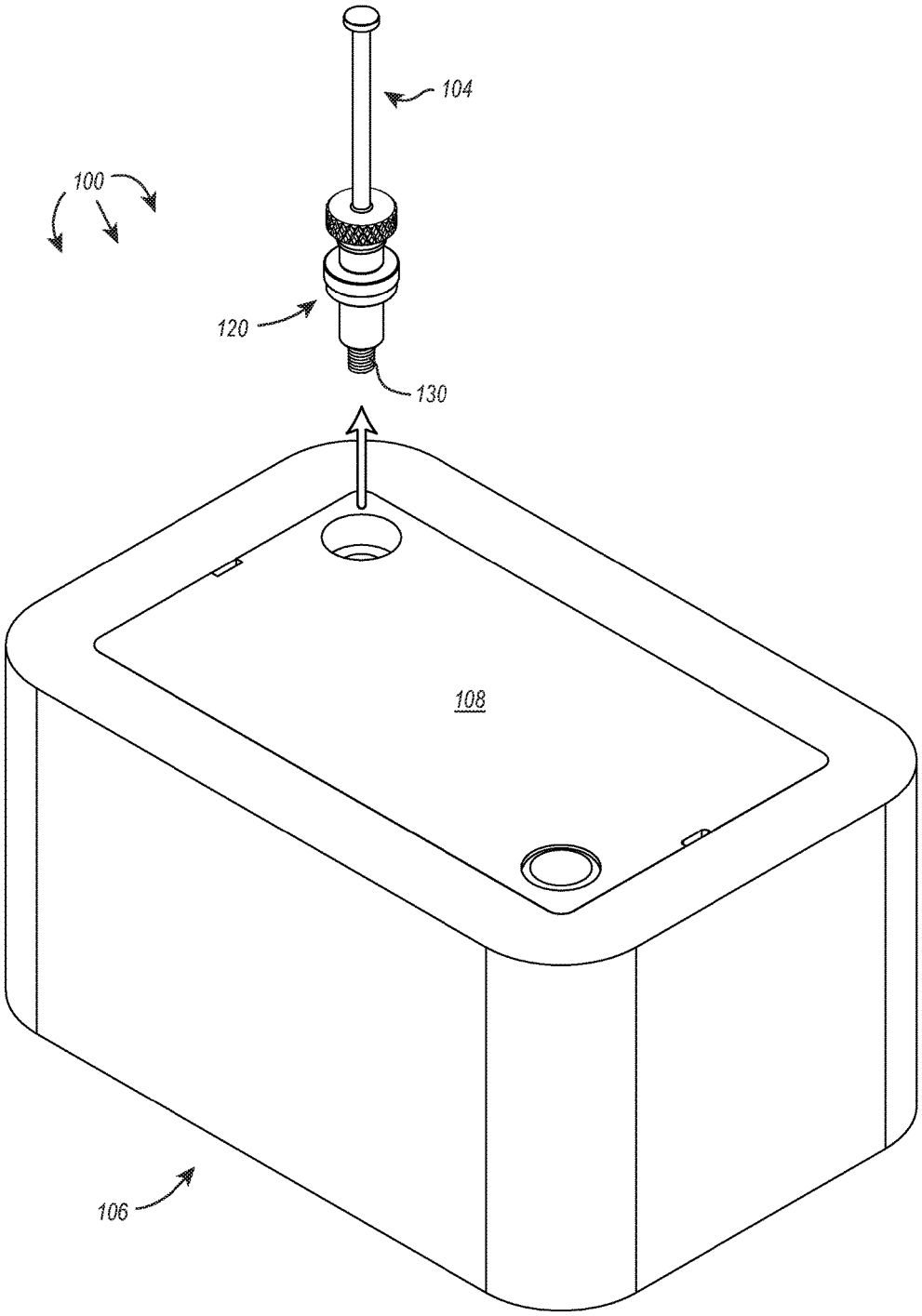
FIG. 3B illustrates a perspective view of the exemplary locking system of FIG. 3A with the lock removed from the housing.

As shown in FIGS. 3A and 3B, the key 104 can be used to disengage the cylindrical lock body 120 from the housing 106 and/or lid 108. The key 104 includes a collar 124 with a cylindrical key body 126 that is sized and shaped to fit within the bore 118, and when the cylindrical key body 126 is positioned within the bore 118, it engages the cylindrical lock body 120. A subsequent rotational force applied to the key 104 disengages the cylindrical lock body 120 from the housing 106 and/or lid 108. In some embodiments, and as shown in FIG. 3A, a gripping region 128 can be provided on the key 104 to assist the user in rotating the cylindrical lock body 120.

As shown in FIG. 3B, the cylindrical lock body 120 includes at least a length thereof that has external threads 130. Accordingly, rotational forces applied to the cylindrical lock body 120 cause it to fasten and unfasten from the housing 106. In some embodiments, the threads are oriented to cause the cylindrical lock body 120 to fasten in a clockwise direction and unfasten in a counterclockwise direction—the traditional "righty-tighty, lefty-loosey" configuration. In some embodiments, the external threads are oriented in an opposite configuration such that counterclockwise rotations cause the cylindrical lock body 120 to fasten, and clockwise rotations cause the cylindrical lock body 120 to unfasten. The reconfiguration of threading can add to the tamper-resistant nature of the lock as the counterintuitive rotation for unfastening the cylindrical lock body from the housing can frustrate the efforts of unauthorized persons. Theft and/or the unauthorized access of a locked space is often a time sensitive undertaking, and without advance notice of mechanical processes such as the thread orientation of a threaded lock body, the typical rotational direction is likely to be attempted first. At the very least, additional time will be needed to discern the proper directionality of rotation to unfasten the cylindrical lock body, assuming the unauthorized person is in possession of the key.

Figure 4:
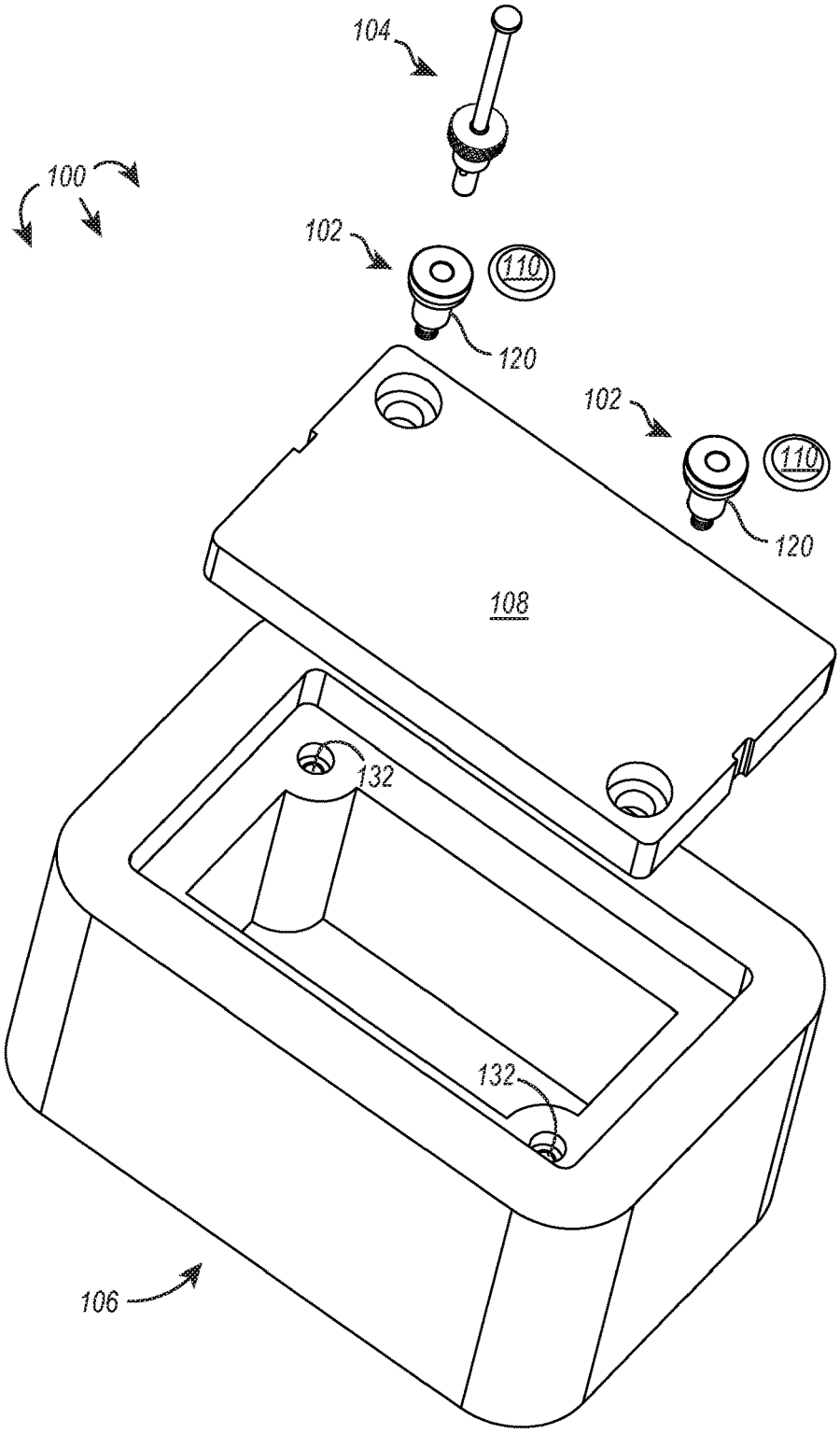
FIG. 4 illustrates an exploded perspective view of the exemplary locking system of FIG. 1 with both of the illustrated locks being disengaged and the lid being removed from the housing.

Referring now to FIG. 4, the locking system 100 is shown in a disassembled state. The two tamper-resistant locks 102 have been removed from associated housing anchors 132 using the key 104. The lid 108 can then be removed from the housing 106 to reveal the housing's internal compartment. As shown in FIG. 4, each housing anchor 132 includes a complementary threaded bore into which the cylindrical lock body 120 of each tamper-resistant lock 102 can fasten.

Exemplary Tamper-Resistant Locks and Associated Keys

The keys used for the tamper-resistant locks disclosed herein are somewhat different than traditional keys (i.e., key used in tumbler or pin-based locks). Traditional keys used for pin-based locks are cut into a particular conformation that will cause differently sized pins within the associated locking mechanism to align, allowing the lock to rotate. If one of the key's teeth is too short or too long, the associated pin will be misaligned, preventing the locking mechanism from freely rotating. These keys typically have a slim profile, as the pins are all oriented within the same plane within the locking mechanism.

Figure 5:
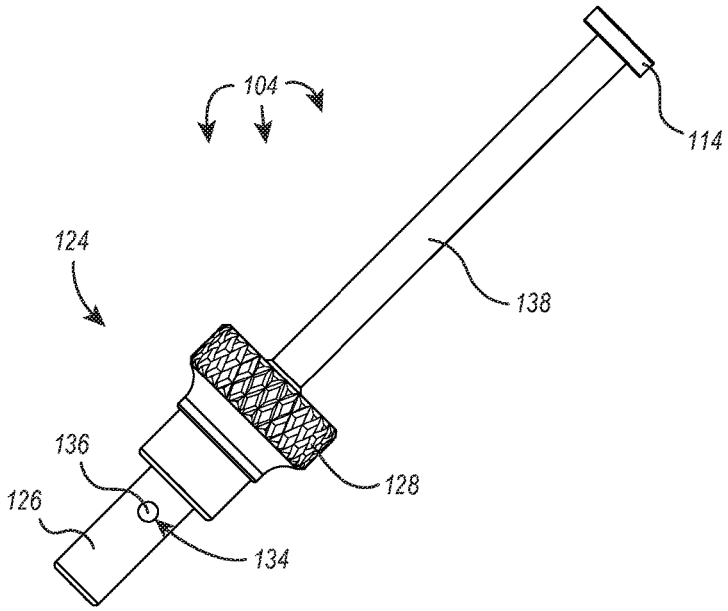
FIG. 5 illustrates an exemplary key for use with tamper-resistant locks disclosed herein.

FIG. 5 illustrates an exemplary key 104 of the present disclosure. Unlike keys typically used with pin-based locking mechanisms that have a slim profile, the key 104 of FIG. 5 includes a collar 124 that has a cylindrical key body 126. The cylindrical key body 126 is sized and shaped to fit within the bore of the cylindrical lock body 120, which is also cylindrically shaped. The side wall of the cylindrical key body 126 defines an opening 134 into which a retractable engagement member 136 is disposed. In some embodiments, the key includes a single retractable engagement member. In some embodiments, and as shown in the cross-sections of FIGS. 6A and 6B, the cylindrical key body 126 can define a plurality of openings 134 into which retractable engagement members 136, 136*a* can be placed. It should be appreciated that because the cylindrical key body 126 is shaped to engage a multidimensional surface, the positioning of retractable engagement members 136 on the cylindrical key body can similarly be multidimensional.

Figure 6A:
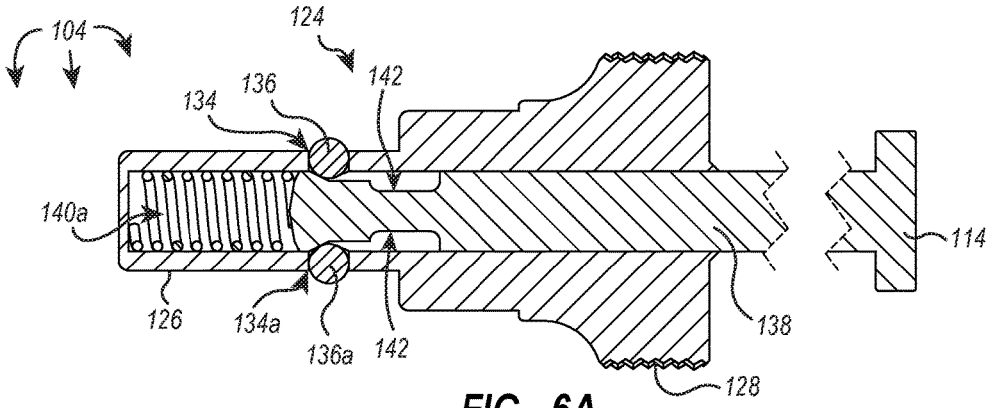
FIG. 6A illustrates a cross-section of the exemplary key of FIG. 5 with the internal spring in a decompressed state.

For example, retractable engagement members can be placed on opposite sides of the cylindrical lock body but otherwise within the same horizontal plane (as shown in FIG. 6A). As an additional example, retractable engagement members can be placed adjacent each other while still remaining in the same horizontal plane. Additionally, or alternatively, retractable engagement members can be placed adjacent and/or opposite each other in the same vertical plane. Additionally, or alternatively, retractable engagement members can be placed adjacent and/or opposite each other in different vertical and/or horizontal planes. By varying the number and/or placement of retractable engagement members vertically and/or horizontally on the cylindrical key body, unique key configurations can be achieved.

As alluded to above and as further shown in FIG. 5, the key 104 can include a gripping region 128. In some embodiments, the gripping region 128 has a larger diameter than the cylindrical key body 126. The larger diameter of the gripping region 128 allows a greater amount of torque to be applied to the key, and as shown in FIG. 5, the gripping region 128 can include knurling to increase grip at the gripping region. In some embodiments, the knurling is replaced with a textured material. In some embodiments, the gripping region is etched to provide a contoured surface that likewise increases grip. In some embodiments, the gripping region is covered with a rubberized material or thermoplastic elastomer that increases a user's grip at the gripping region.

Figure 6B:
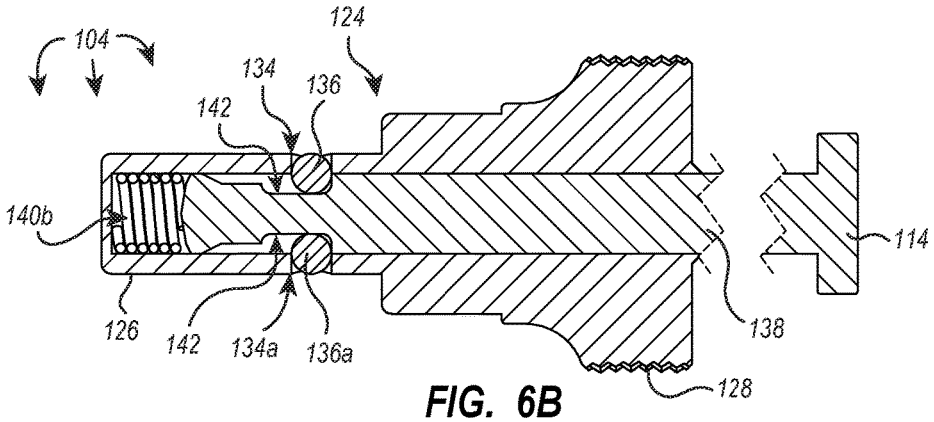
FIG. 6B illustrates a cross-section of the exemplary key of FIG. 5 with the internal spring in a compressed state.

The key 104 can additionally include a plunger 138 with the magnet 114 disposed at a proximal end thereof. As perhaps better illustrated in FIGS. 6A and 6B, the plunger 138 extends from its proximal end into the collar 124 where it terminates at a distal end. The distal end of the plunger interfaces with a spring disposed within the collar 124. The plunger 138 can rest on an uncompressed spring 140*a* (as shown in FIG. 6A). The plunger 138 can also be depressed within the collar 124, compressing the spring 140*b* (as shown in FIG. 6B).

Proximate the distal end of the plunger 138 is a recess 142 in the body of the plunger 138. The axial movement of the plunger 138 within the collar 124 compresses and decompresses the spring (140*b* and 140*a*, respectively) and acts to move the recess 142 into and out of position beneath the retractable engagement members 136, 136*a*. That is, in some embodiments, as the plunger 138 compresses the spring 140*b*, the recess 142 moves into position beneath the retractable engagement members 136, 136*a*. The retractable engagement members 136, 136*a* can then be positioned (whether by physical depression into the recess 142 or by falling therein by the force of gravity) within the recess 142. As shown in FIG. 6B, the recess 142 is an annular channel sized and shaped to accommodate the retractable engagement members 136, 136*a* such that the retractable engagement members 136, 136*a* do not substantially protrude from the sidewall defining the openings 134, 134*a* or otherwise interfere with the cylindrical key body 124 traversing the bore 118 of the tamper-resistant lock 102 when positioned within the recess 142. Similarly, when the compressive force is removed from the plunger 138 and spring 140*b*, the spring pushes the plunger 138 directionally away, causing misalignment of the recess 142 with the retractable engagement members 136, 136*a*. This movement also causes the retractable engagement members 136, 136*a* to at least partially protrude from corresponding openings 134, 134*a* in the sidewall of the cylindrical key body 126. Thus, in some embodiments, depressing and releasing the plunger 138 causes the retractable engagement members 136, 136*a* to transition between extended and retracted positions.

In some embodiments, the openings in the sidewall are initially made slightly larger than the retractable engagement members so the retractable engagement members may be freely placed through the opening and into the interior portion of the collar. After being placed through the opening, the opening is crimped to a smaller diameter, thereby preventing the retractable engagement member from fully transitioning back through the opening. In an exemplary embodiment, the engagement member is ⅛" in diameter, and the opening is 3⁄16" in diameter or larger. The engagement member is placed through the opening, and then, the opening is crimped to a diameter of 3⁄28" or less to prevent the engagement member from being dislodged therefrom. It should be appreciated, however, that other measurements are included within this disclosure and any of the aforementioned components can be sized and shaped in any reasonable dimension to achieve the same result.

Figure 7:
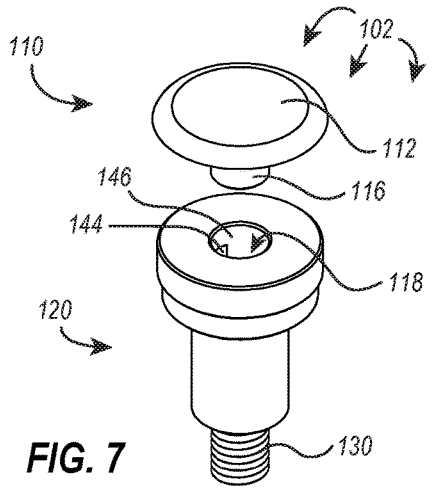
FIG. 7 illustrates a cylindrical lock body and bore cap of an exemplary tamper-resistant lock.
Figure 8A:
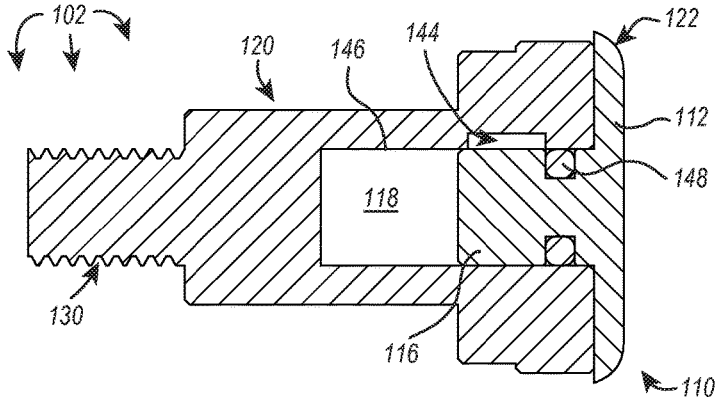
FIG. 8A illustrates a cross-section of the exemplary tamper-resistant lock of FIG. 7 with the bore cap associated with the cylindrical lock body.
Figure 8B:
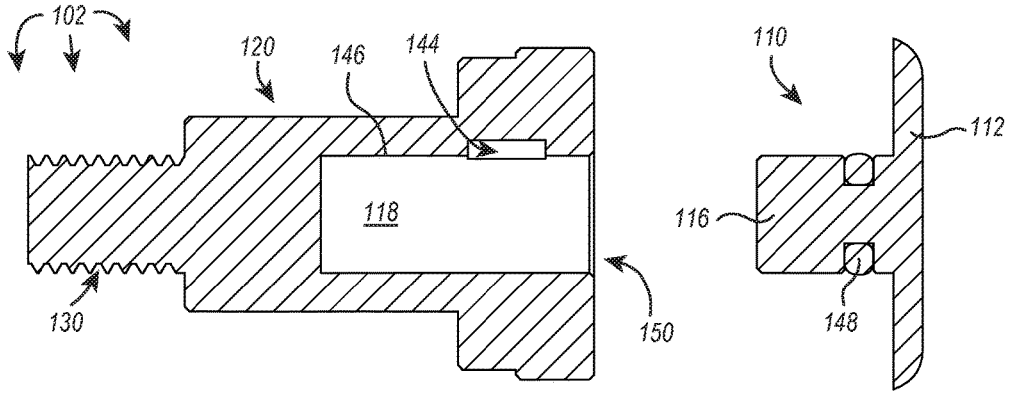
FIG. 8B illustrates a cross-section of the exemplary tamper-resistant lock of FIG. 7 with the bore cap removed from the cylindrical lock body, revealing the bore opening.

Referring now to FIGS. 7, 8A, and 8B, illustrated is a tamper-resistant lock 102 in a perspective view (FIG. 7) and cross-sectional views (FIGS. 8A and 8B). The tamper-resistant lock 102 includes a cylindrical lock body 120 having a bore 118 defined by an interior sidewall 146 thereof in at least a portion of a length thereof having external threads 130. As illustrated, the lower end of the cylindrical lock body 120 includes external threads 130 and is also smaller in diameter than the cylindrical body 120. It should be appreciated, however, that in some embodiments the cylindrical lock body may have a uniform diameter or may comprise a non-cylindrical shape (e.g., a rectangular prism, other three-dimensional polygonal and/or arcuate shapes, or combinations thereof).

The cylindrical lock body 120 may additionally include one or more engagement features 144 disposed and/or formed into the interior sidewall 146 of the bore 118. In some embodiments, the engagement feature 144 is sized and shaped to receive one or more retractable engagement members of a corresponding key. In an embodiment, the engagement feature can be an elongate channel having a semicircular, concave surface. In another embodiment, the engagement feature can be a depression within the sidewall that corresponds to and/or complements the size and/or shape of the retractable engagement member on a corresponding key. It should be appreciated that each engagement feature 144 is disposed a particular distance away from the opening 150 of the bore 118, and in some embodiments, that particular distance corresponds to the distance that a retractable engagement member is positioned along the cylindrical key body when the cylindrical key body is associated with the bore.

The tamper-resistant lock 102 also includes a bore cap 110 having a head 112 and a stem 116. As shown in FIG. 8A, the stem 116 is sized and shaped to fit within the bore 118, and in some embodiments, the bore cap 110 additionally includes a sealing member 148. In some embodiments, the sealing member 148 is an annular sealing member, such as an O-ring and acts to secure the bore cap 110 within the bore 118. When the bore cap 110 is associated with the bore 118, the sealing member 148 can through an interference fit create a tight association between the bore cap 110 in the cylindrical lock body 120 such that the bore cap 110 cannot be readily removed from the bore 118. As shown in FIG. 8A, the sealing member 148 can be positioned on the stem 116 at a location where it does not interfere with and/or interface with an engagement feature 144.

In some embodiments, the diameter and/or material of the sealing member can be adjusted, as known in the art, to increase or decrease the friction between the bore cap 110 and the interior sidewall 146 of the bore 118. For example, a sealing cap having a sealing member with a smaller diameter will likely require less force to disassociate from the cylindrical lock body than a bore cap having a sealing member with a larger diameter. In some embodiments, a plurality of sealing members can be disposed on the stem of the bore cap to increase the force required to disassociate the bore cap from the cylindrical lock body. It should be appreciated that the number and type of sealing members used may be commensurate with the amount of force desired for disassociating the bore cap from the cylindrical lock body. A tighter fit may increase the tamper-resistant nature of the lock, as it would be more difficult to remove the bore cap without the appropriate equipment.

In some embodiments, at least a portion of the bore cap 110 (e.g., the cap head 112) is made from a ferrous metal that responds to a magnetic field such that the bore cap 110, when interfaced with a magnet of sufficient strength to overcome the retention force of the interference fit formed by the sealing member 148 and the interior sidewall 146 of the cylindrical lock body 120, can be removed using said magnet. In some embodiments, the bore cap can be removed by a magnet having a pull force of greater than 5 lbs., greater than 10 lbs., greater than 20 lbs., greater than 30 lbs., greater than 40 lbs., greater than 50 lbs., greater than 75 lbs., greater than 100 lbs., or more.

Once the bore cap is removed from the cylindrical lock body, the bore opening is revealed (see, for example, FIG. 8B). However, in the event that an unauthorized individual removes the bore cap from the locking system or if the bore cap is inadvertently removed therefrom, the exposed bore is—at least at first blush—a round/arcuate hole with no readily visible elements that can be engaged with traditional tools (e.g., a screwdriver, a wrench, etc.). Partially hidden on the sidewall of the cylindrical lock body is a recess (see, for example, recess 144 of FIGS. 9A and 9B). The recess can be engaged by a bit or engagement member disposed on a specialized key, which when engaged therewith can provide a user with sufficient leverage to disengage the cylindrical lock body from its corresponding lock anchor.

Figure 9A:
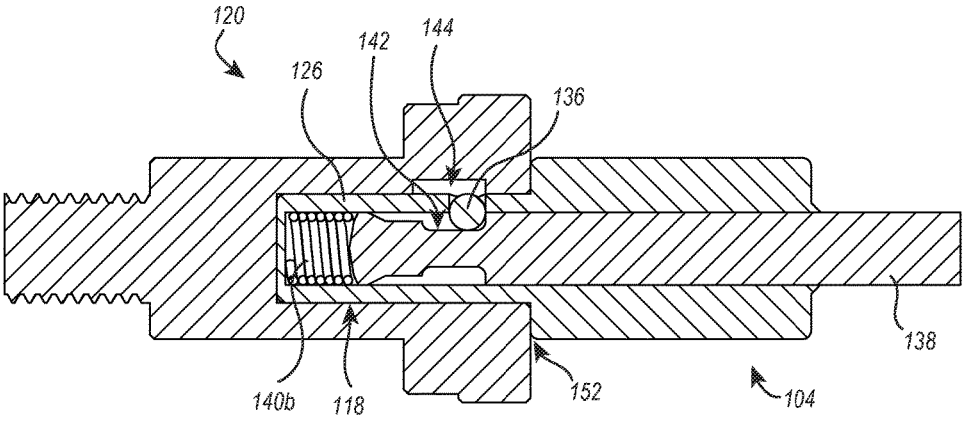
FIG. 9A illustrates an exemplary key associated with the cylindrical body of an exemplary tamper-resistant lock with the internal spring of the key being in a compressed state and the engagement member depressed within a recess of the plunger.
Figure 9B:
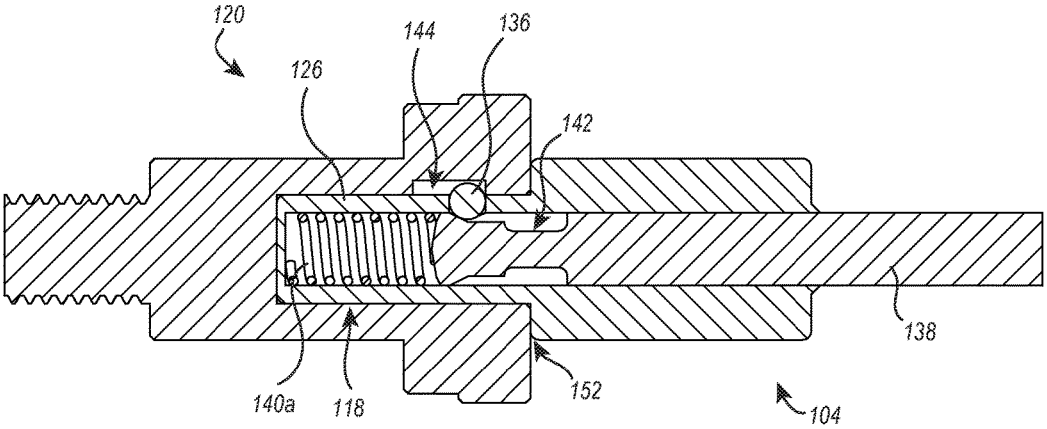
FIG. 9B illustrates the exemplary key, tamper-resistant lock of FIG. 9A with the internal spring of the key being in a decompressed state and the engagement member protruding into the engagement feature of the bore sidewall.

FIGS. 9A and 9B illustrate such an association, and more particularly illustrate the retractable engagement member 136 engaging with the engagement feature 144 of the cylindrical lock body 120. As shown in FIG. 9A, the plunger 138 is depressed, compressing spring 140*b*, in moving recess 142 and positioned beneath retractable engagement member 136. As the cylindrical key body 126 enters the bore 118, the retractable engagement member 136 can be depressed so as to not impede progress of the cylindrical key body 126 into the bore 118. Once the retractable engagement member 136 passes the opening of the bore 118 the plunger 138 can be released (as shown in FIG. 9B). The energy stored in the compressed spring 140*b* is released, pushing the plunger 138 axially away from the bore 118 and causing the recess 142 to be misaligned with the retractable engagement number 136. In turn, the retractable engagement member 136 is moved into an extended position within the engagement feature 144.

In some embodiments, the cylindrical key body 126 can be inserted into the bore 118 in a rotational configuration where the retractable engagement member(s) 136 are out of alignment with corresponding engagement feature(s) 144. The cylindrical key body 126 can be rotated within the bore 118 until the retractable engagement member(s) 136 are properly aligned with their corresponding engagement feature(s) 144. In some embodiments, the pressure of the retractable engagement member 136 pressing against the interior sidewall 146 of the bore 118 (in an unaligned configuration) is sufficient to prevent the plunger 138 from fully extending axially away, and upon proper alignment, the retractable engagement member 136 can snap into position within its corresponding engagement feature 144, finally allowing the plunger 138 and/or spring 140*a* to fully extend. In this way, a key having an improper configuration of retractable engagement members with respect to corresponding engagement features of the lock body cannot be used to engage the lock body, even if a single retractable engagement member is misaligned. A misaligned retractable engagement member will press against the interior sidewall of the bore and prevent the plunger from returning to a position that allows the cylindrical key body (e.g., the retractable engagement features) to securely engage the cylindrical lock body (e.g., the engagement features). As such, the cylindrical key body would rotate inside the bore without gaining sufficient purchase to rotationally disengage the cylindrical lock body.

In some embodiments, the key 104 includes a flange 152 positioned adjacent the cylindrical key body 126. The flange 152 can abut against a top surface of the cylindrical lock body 120, stopping progress of the cylindrical key body 126 within the bore 118. This can aid in the alignment of retractable engagement members 136 with their corresponding engagement feature 144, as the cylindrical key body 126 will enter the bore 118 a defined distance when the flange 152 and the top surface of the cylindrical lock body 120 interact and prevent further axial movement. Accordingly, the axial distance between the opening 150 of the bore 118 and engagement feature 144 will substantially correspond to the axial distance between the flange 152 and the corresponding retractable engagement feature 136 on a complementary key 104. The proper rotational alignment can then easily be found by implementing a clockwise or counterclockwise rotation of the cylindrical key body.

In some embodiments, the key does not include a flange or the flange does not impede axial progress of the cylindrical key body was in the bore. Rather, the cylindrical key body extends all the way into the bore and bottoms out on the surface of the cylindrical lock body sidewall that defines the bottom edge of the bore, thereby halting its axial progress within the bore. The retractable engagement members and corresponding engagement features can they be measured and/or defined by a particular distance away from terminal, distal end of the cylindrical lock body and the bottom edge of the bore, respectively.

In some embodiments, and as shown in FIGS. 9A and 9B, the cylindrical key body 126 is sized and shaped to fit within a complementary bore 118 of the cylindrical lock body 120 such that axial movements in and out of the bore 118 are permitted and lateral movements within the bore 118 are reduced. This may be enabled by making the diameter of the bore 118 slightly larger than the diameter of the cylindrical key body 126. For example, the diameter of the bore may be manufactured with an upper threshold tolerance such that the diameter of the bore is no more than 5 mm larger than the diameter of the cylindrical key body, no more than 2.5 mm larger than the diameter the cylindrical key body, no more than 1 mm larger than the diameter of the cylindrical key body, no more than 0.9 mm larger than the diameter of this cylindrical key body, no more than 0.8 mm larger than the diameter the cylindrical key body, no more than 0.7 mm larger than the diameter of the cylindrical key body, no more than 0.6 mm larger than the diameter of the cylindrical key body, no more than 0.5 mm larger than the diameter of the cylindrical key body, no more than 0.4 mm larger than the diameter the cylindrical key body, no more than 0.3 mm larger than the diameter of the cylindrical key body, no more than 0.2 mm larger than the diameter to cylindrical key body, no more than 0.1 mm larger than the diameter of the cylindrical key body, no more than 0.75 mm larger than the diameter of the cylindrical key body, no more than 0.50 mm larger than the diameter of cylindrical key body, no more than 0.25 mill meters larger than the diameter the cylindrical key body, or no more than 0.1 mm larger than the diameter the cylindrical key body, and the diameter of the bore may be manufactured with a lower threshold tolerance such that the diameter of the bore is no less than 0.01 mm larger than the diameter of the cylindrical key body, no less than 0.25 mm larger than the diameter of cylindrical key body, no less than 0.5 mm larger than the diameter the cylindrical key body, no less than 0.75 mm larger than the diameter of the cylindrical key body, no less than 0.1 mm larger than the diameter of the cylindrical key body, no less than 0.2 mm larger than the diameter of the cylindrical key body, no less than 0.3 mm larger than the diameter the cylindrical key body, no less than 0.4 mm larger than the diameter of cylindrical the body, no less than 0.5 mm larger than the diameter the cylindrical key body, no less than 0.6 mm larger than the diameter of the cylindrical key body, no less than 0.7 mm larger than the diameter of cylindrical key body, no less than 0.8 mm larger than the diameter of this cylindrical key body, no less than 0.9 mm larger than the diameter the cylindrical key body, no less than 1 mm larger than the diameter of the cylindrical key body, no less than 2.5 mm larger than the diameter of cylindrical key body, no less than 5 mm larger than the diameter of the cylindrical key body, or any tolerance range selected using any of the foregoing upper and lower bounds.

It should be appreciated that while the ranges and bounds of manufacturing tolerances provided above were recited from the perspective of drilling (or otherwise forming) the bore, similar manufacturing tolerances can be used when manufacturing the cylindrical key body. Obviously, however, the recited manufacturing tolerances above will be inverted, as appropriate, such that the cylindrical key body is manufactured to be smaller in diameter than that of the bore (e.g., the cylindrical key body having a diameter that is at least less than 0.1 mm smaller than the diameter of the bore and no more than 1 mm smaller than the diameter of the bore).

Figure 10A:
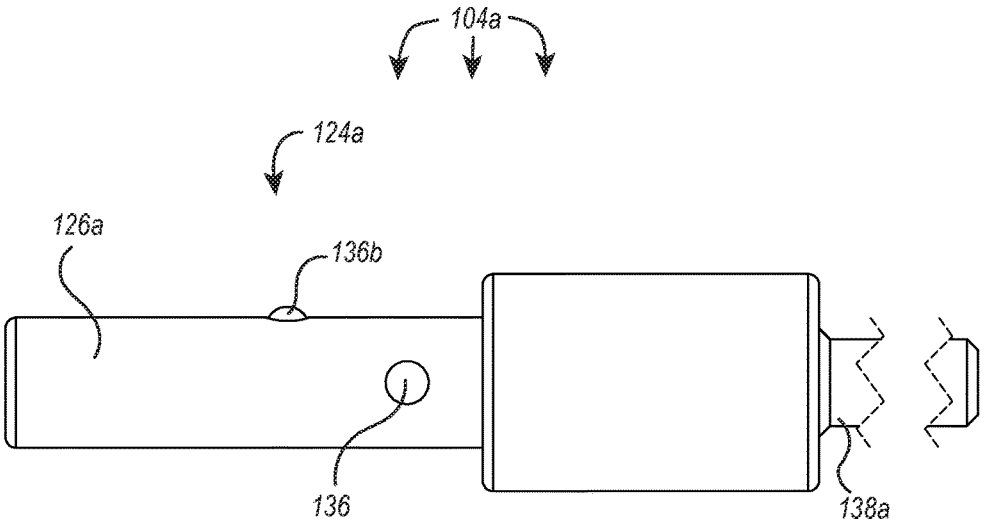
FIG. 10A illustrates another exemplary key having two offset engagement members.
Figure 10B:
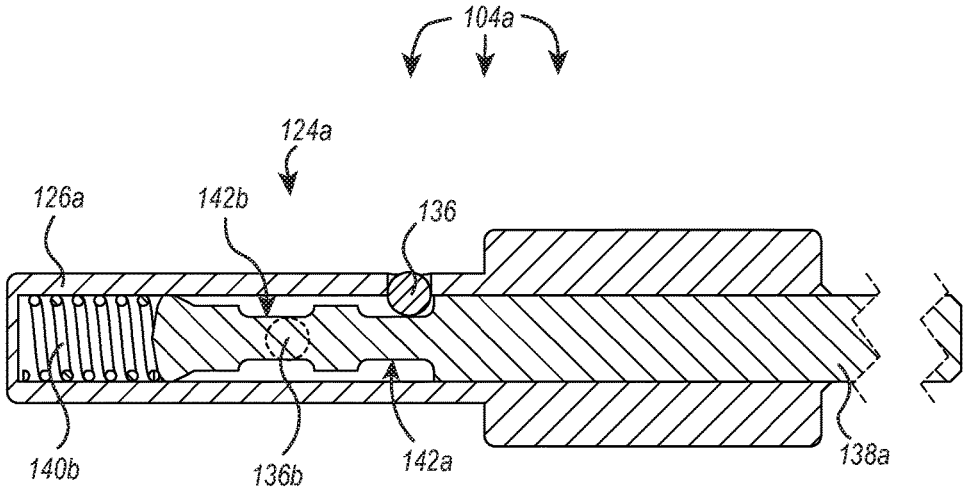
FIG. 10B illustrates a cross-sectional view of the key of FIG. 10A.

In some embodiments, and as shown in FIGS. 10A and 10B, a key 104*a* can include a plurality retractable engagement members 136, 136*b* disposed along the cylindrical key body 124*a*. For example, a second retractable engagement member 136*b* can be positioned in a different orthogonal cross-section from the first retractable engagement member 136. FIG. 10B illustrates a cross-section of the key 104*a* of FIG. 10A, rotated 90° counterclockwise. As shown in FIG. 10B, the key 104*a* includes a plunger 138*a* that has a two recesses 142*a*, 142*b*, one associated with each retractable engagement member 136, 136*b*. Accordingly, the plunger 138*a* is depressed (as shown in FIG. 10B), the recesses 142*a*, 142*b* are positioned beneath the retractable engagement members 136, 136*b*, and the retractable engagement members 136, 136*b* can be depressed within its corresponding opening as described above.

As shown in FIG. 10B, the recesses 142*a*, 142*b* can be annular recesses that can accommodate a retractable engagement member positioned within any orthogonal cross-section of the cylindrical key body 126*a* that overlaps the recess. Accordingly, the plunger 138*a* does not have to be locked in a single rotational plane because the annular recess makes all rotational positions available to receive a corresponding retractable engagement member. In some embodiments, however, the recess is not an annular recess. Rather, the recess is a scoop and/or divot that is axially aligned with its corresponding retractable engagement member.

In some embodiments, the number and positioning of retractable engagement members is greater and/or different than that shown in FIGS. 10A and 10B. For example, a key may include a plurality of retractable engagement members that are axially aligned and/or within the same orthogonal cross-section. Additionally, or alternatively, a key may include a plurality of retractable engagement members where at least two retractable engagement members are not axially aligned and/or within the same orthogonal cross-section.

Figure 11:
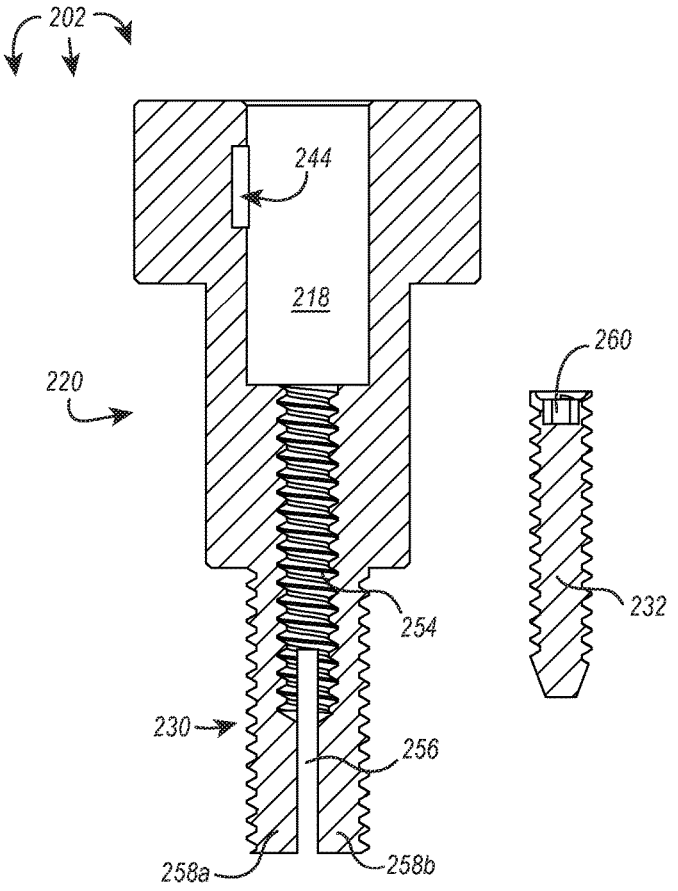
FIG. 11 illustrates an exemplary tamper-resistant lock having a split shaft and a lock anchor.

Referring now to FIG. 11, illustrated is an exemplary tamper-resistant lock 202 having a split shaft 258*a*, 258*b* and a lock anchor 232. Many components of the tamper-resistant lock 202 are substantially similar to the tamper-resistant lock 102 described above. For example, the tamper-resistant lock 202 includes a cylindrical lock body 220 having a bore 218 and an engagement feature 244 that is defined by the sidewall of the bore 218, and analogous structures were described above with respect to the tamper-resistant lock 102. Additionally, the tamper-resistant lock 202 includes external threads 230 on a portion of the length of the cylindrical lock body 220.

However, the portion of the cylindrical lock body 220 that includes external threads 230 has been split, forming a split shaft 258*a*, 258*b*, whereas the cylindrical lock body 120 described above at a uniform, unsplit shaft. The cylindrical lock body 220 additionally includes an anchoring member 254 that spans in an axial direction from the sidewall defining the bottom surface of the bore 218 to the split shaft 258*a*, 258*b*. In some embodiments, and as depicted in FIG. 11, the anchoring member 254 includes a threaded bore, the threads being complementary to threads found on the lock anchor 232.

In some embodiments, the lock anchor 232 can be driven into the anchoring member 254, which causes each arm 258*a*, 258*b* of the split shaft to bias outward. If the external threads are fastened and/or engaged within the housing (e.g., by complementary threads of a housing anchor) when the lock anchor 232 is driven into the anchoring member 254, the arms 258*a*, 258*b* of the split shaft will bias outward against the housing anchor to functionally lock the cylindrical lock body 220 in its current location. In some embodiments, the cylindrical lock body 220 cannot be rotated in any direction until the lock anchor 232 is removed.

As shown in FIG. 11, the lock anchor 232 includes a bit port 260. The bit port 260 is illustrated as being configured to receive a hex key. However, the bit port can have any number or type of configurations including, for example, an X-shaped socket for receiving a Phillips screwdriver. In some embodiments, the bit port is functionally equivalent to a hexagonally-shaped head on the lock anchor.

Figure 12:
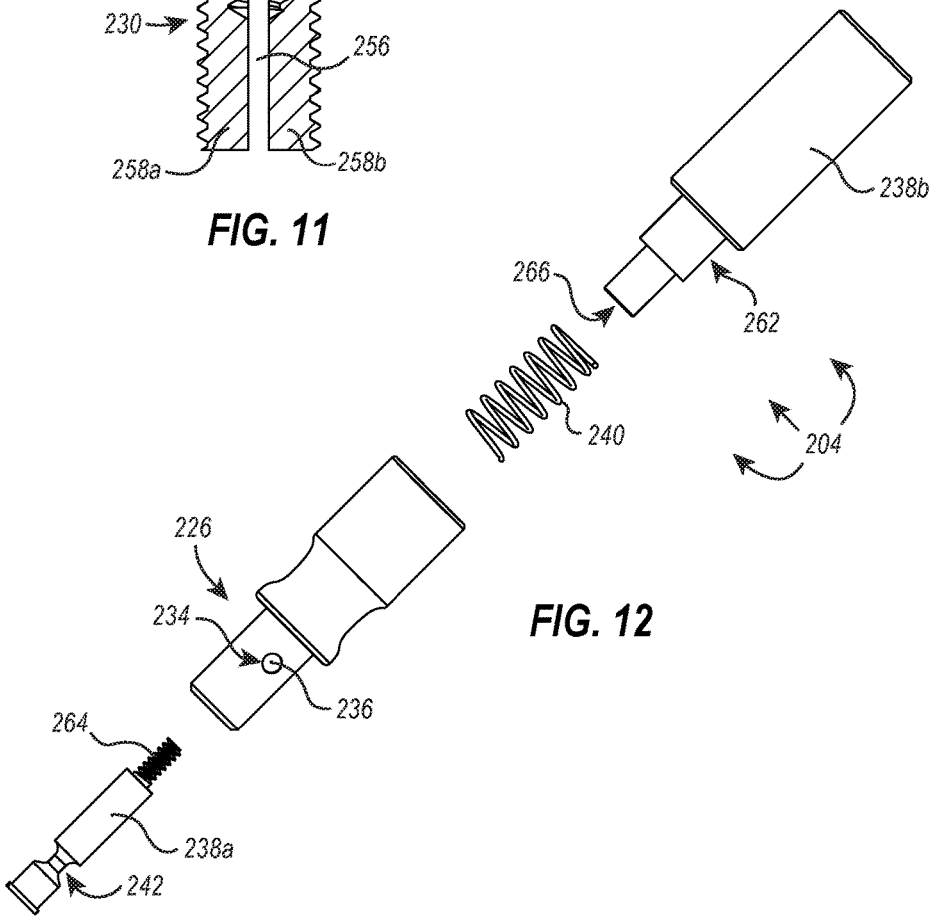
FIG. 12 illustrates an exploded view of another exemplary key.

Referring now to FIG. 12, illustrated is an exploded view of an alternative key 204 that functions in an analogous way to the key 104 discussed above. The key 204 includes a lower plunger piece 238*a* that threadedly connects to an upper plunger piece 238*b* through the cylindrical key body 226. The alternative key 204 includes a collar sidewall that defines an opening 234 through which a retractable engagement member 236 is positioned. The spring 240 of the alternative key 204 is positioned to at least partially surround a collar 262 of the upper plunger piece 238*b* and extend into an interior portion of the cylindrical key body 226. Depression of the upper plunger piece 238*b* causes compression of the spring 240 and movement of the lower plunger piece 238*a* into a position beneath the retractable engagement member 236—functioning in an analogous way to the key 104 disclosed above.

Locking Systems Incorporating Lock Anchors within the Tamper-Resistant Lock

The locking systems described above in FIGS. 1-4 could be used in some embodiments as a retrofit to many existing housing elements (e.g., many electrical boxes have a similar configuration but use hex bolts in place of the tamper-resistant lock). In some embodiments, the housing element may need to be replaced or fitted with a different lid. An exemplary locking system is disclosed in FIGS. 13-16 that can be used as a retrofit to existing housings or as an entirely new housing and integrated locking system altogether.

Figure 13:
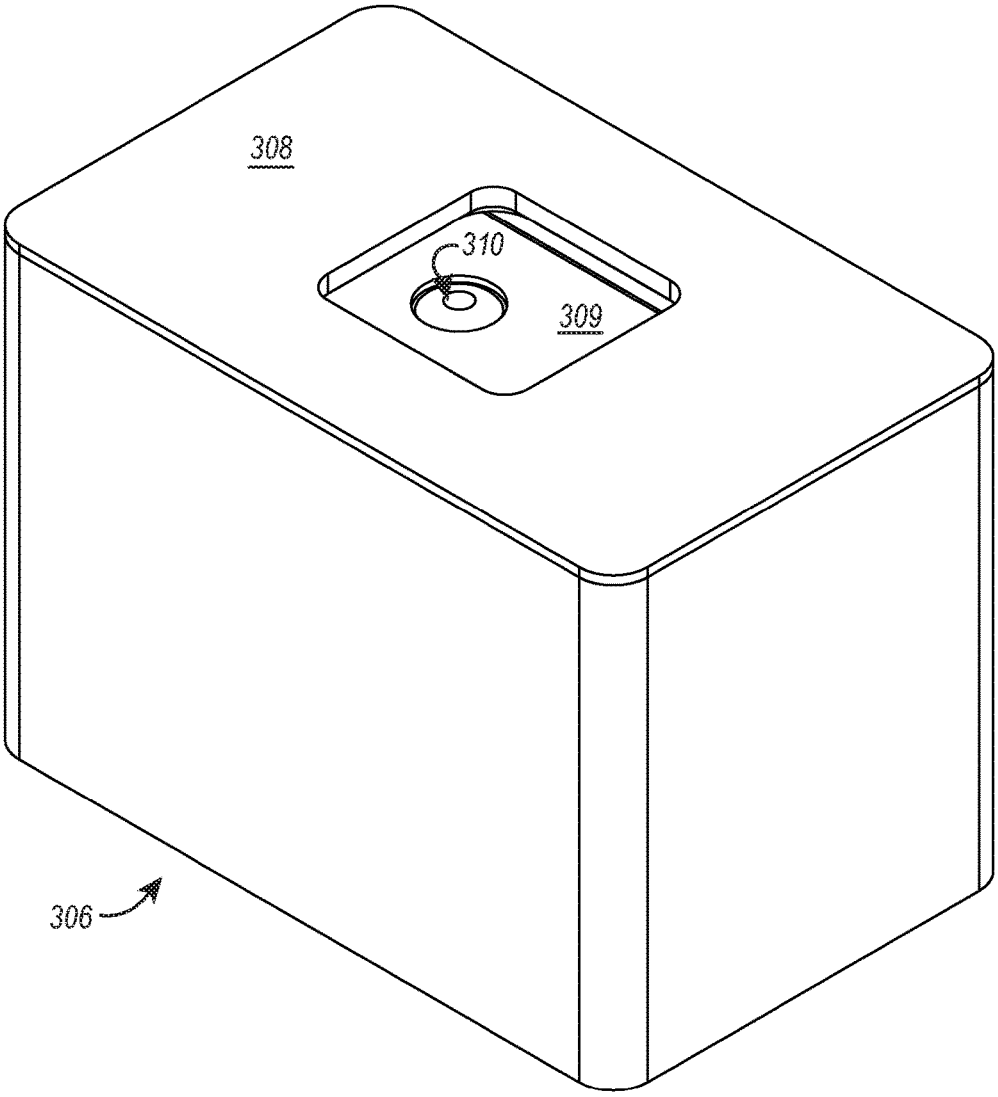
FIG. 13 illustrates an exemplary locking system securing a lid to a housing.

FIG. 13 illustrates an assembled locking system that is securing a lid 308 to housing 306. In an assembled state, the only viewable components are the housing 306, the lid 308, the inner lid 309, and the head of a bore cap 310. The inner lid 309 is recessed within the lid 308 and pressed firmly there against leaving no discernible gap between the two lids 308, 309. The bore cap 310 is similar in shape and function as the bore caps described above. For example, the bore cap 310 includes a head with the beveled edge that is at least partially recessed within the inner lid 309 to prevent tampering and/or leveraging of the bore cap 310 away from the inner lid 309.

Figure 14:
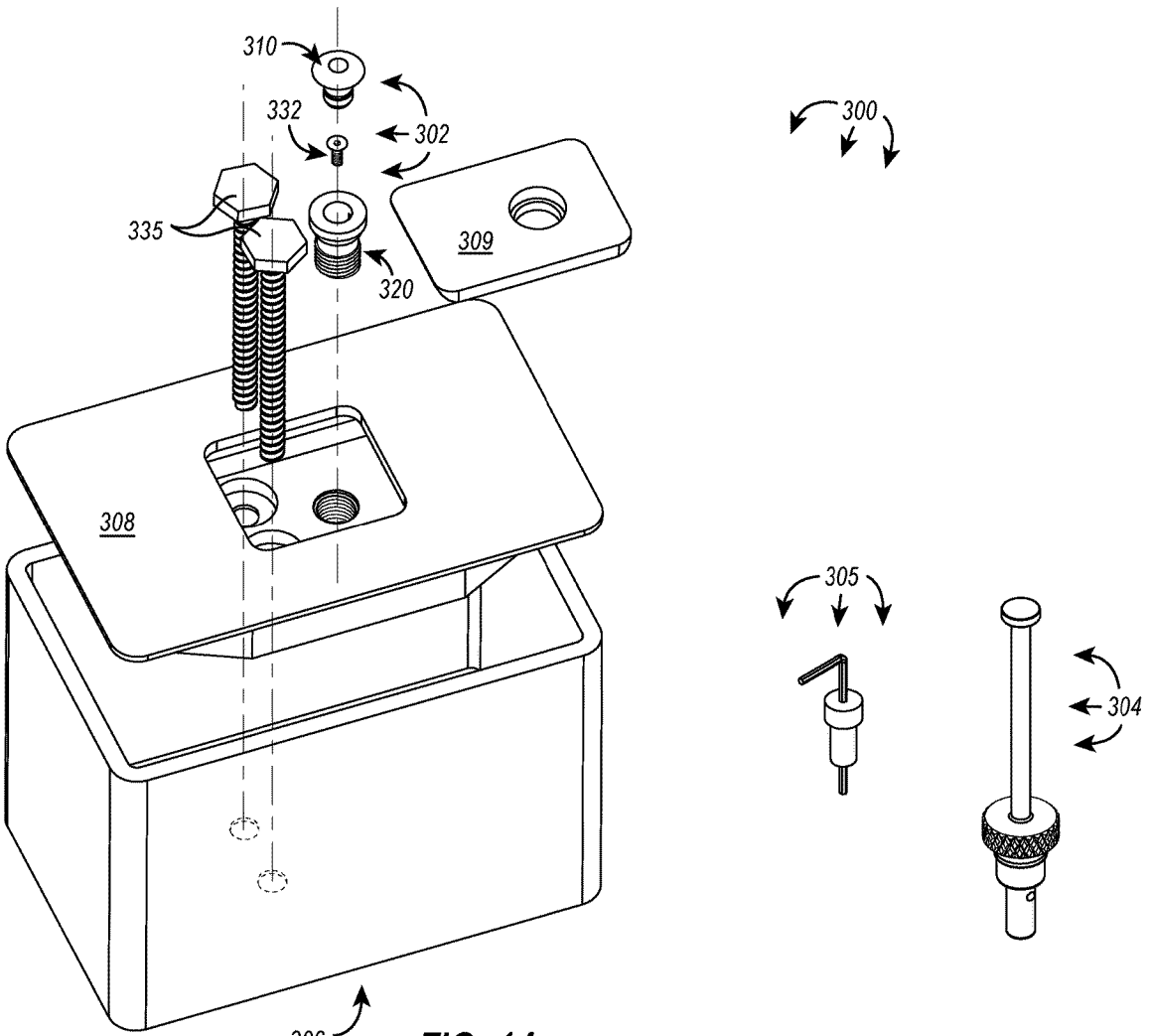
FIG. 14 illustrates an exploded view of the exemplary locking system and housing of FIG. 13.

FIG. 14 illustrates an exploded view of the exemplary locking system 300 and housing 306 of FIG. 13. As shown, the lid 308 is secured to the housing 306 by a plurality of securing members 335 that threadedly engage the housing 306 or an anchor associated therewith. The securing members 335 are depicted in FIG. 14 as threaded bolts having a hexagonally shaped head, although it should be appreciated that the securing members can have any shape or configuration known in the art. In some embodiments, only a single securing member 335 is used to secure the lid 308 to the housing 306.

As further shown in FIG. 14, the inner lid 309 is secured to the lid 308, thereby concealing securing members 335, with a tamper-resistant lock 302. The cylindrical lock body 320 of the tamper-resistant lock 302 passes through an opening in the inner lid 309 and threadedly engages the lid 308. A flange associated with the cylindrical lock body 320 engages a ledge on the inner lid 309 to lock the inner lid 309 onto lid 308. As described in more detail below, attachment mechanism 332 further secures/anchors the cylindrical lock body 320 to the lid 308, and as described above, the bore cap 310 can associate with the cylindrical lock body 320 to occlude its opening. The locking system 300 additionally includes a key 304 and a second key 305 configured in size and shape to engage one or more components of the tamper-resistant lock 302.

Figure 15A:
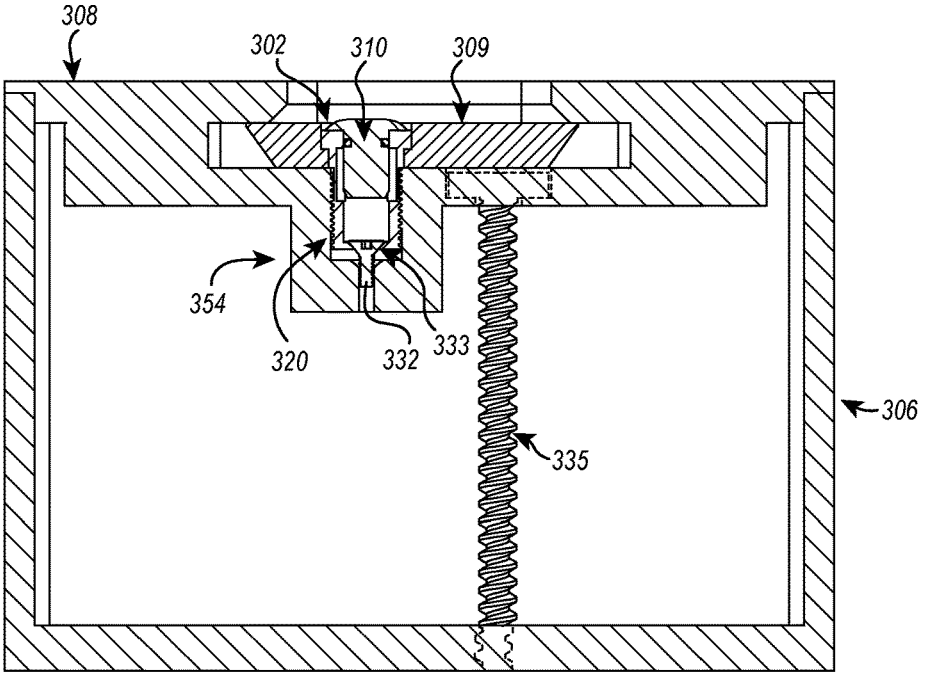
FIG. 15A illustrates a cross-section of the locking system and housing of FIG. 13 with the locking system fully locked.
Figure 15B:
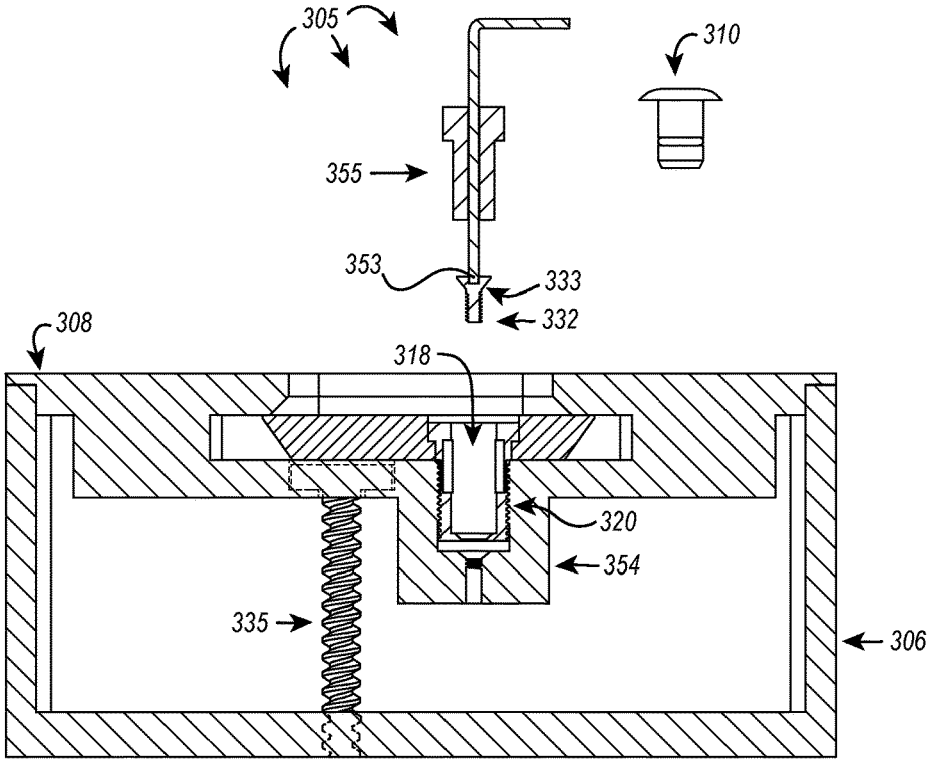
FIG. 15B illustrates a cross-section of the locking system and housing of FIG. 13 with the bore cap and lock anchor removed.
Figure 15C:
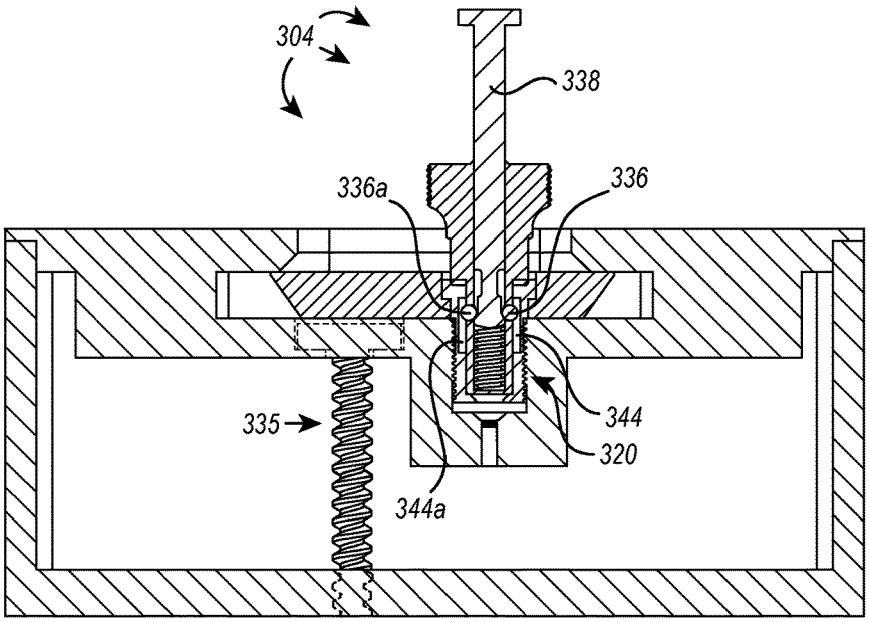
FIG. 15C illustrates a cross-section of the locking system and housing of FIG. 13 with the key engaging the cylindrical lock body.

FIGS. 15A-15C illustrate cross-sections of the housing 306 and associated locking system 300 of FIGS. 13 and 14 in progressive stages of engagement by key 304 and second key 305 for disengaging the tamper-resistant lock 302.

FIG. 15A illustrates a cross-section of the housing 306 and locking system 300 as shown in FIG. 13. As shown, the securing member 335 retains the lid 308 in secure communication with housing 306. The inner lid 309 acts to occlude the securing member 335 from view and/or prevent direct tampering. The lid 309 is secured to and locked to lid 308 by tamper-resistant lock 302. Tamper-resistant lock 302 is similar in many respects to the tamper-resistant locks described above. For example, the bore cap 310 is substantially similar to the bore caps described above-both with respect to structure and function. The cylindrical lock body 320 is also similar to the cylindrical lock bodies described above—both with respect to structure and function. As illustrated, the cylindrical lock body 320 acts to secure the inner lid 309 to the lid 308.

However, the cylindrical lock body 320 has an additional feature not previously described above. The cylindrical lock body 320 is associated with a lock anchor for selectively securing the cylindrical lock body 320 to an anchoring member 354 (e.g., the lid 308). The lock anchor is illustrated as an attachment mechanism 332 that selectively couples the lower end of the cylindrical lock body 320 to the lid 308, and in some embodiments, and as illustrated in FIG. 15A, the attachment mechanism is a bolt that threadedly engages the lid 308 at an anchoring position (e.g., a complementary threaded bore on the lid 308). The head 333 of the attachment mechanism 332 can have any shape or configuration. However, as illustrated in FIG. 15A, the head 333 is configured to engage a hex key.

Referring now to FIG. 15B, the attachment mechanism 332 has been removed from its association with the cylindrical lock body 320. This can be accomplished as described above. As an exemplary illustration, the key 304 of FIG. 14 can include a magnet that can magnetically engage the bore cap 310; the bore cap 310 can then be pulled free from its association with the cylindrical lock body 320. As shown in FIG. 15B, the second key 305 can be used to engage and remove the attachment mechanism 332 from the anchoring member 354. The second key 305 can include a bit 353 that is sized and shaped to engage the head 333 of attachment mechanism 332. For example, the bit 353 can in some embodiments be a hex key. In some embodiments, the bit is X-shaped to accommodate a Phillips screwdriver, or it can be any other configuration or socket known in the art.

The second key 305 can additionally include a guide 355. In some embodiments, the guide 355 is sized and shaped to fit within the bore 318 defined by the cylindrical lock body 320, and in this way, it can more stably and/or accurately guide the bit 353 into communication with the attachment mechanism 332. In some embodiments, the guide includes a flange that regulates penetrative depth of the second key within the bore of the cylindrical lock body.

With the attachment mechanism 332 is removed, the cylindrical lock body 320 can now be engaged and removed using the key 304, as described above in FIGS. 1-10B. For example, FIG. 15C illustrates two retractable engagement members 336, 336*a* positioned within engagement features 344, 344*a*, respectively. The key 304 can then be rotated to unfasten the cylindrical lock body 320 from the lids 308, 309.

Figure 16:
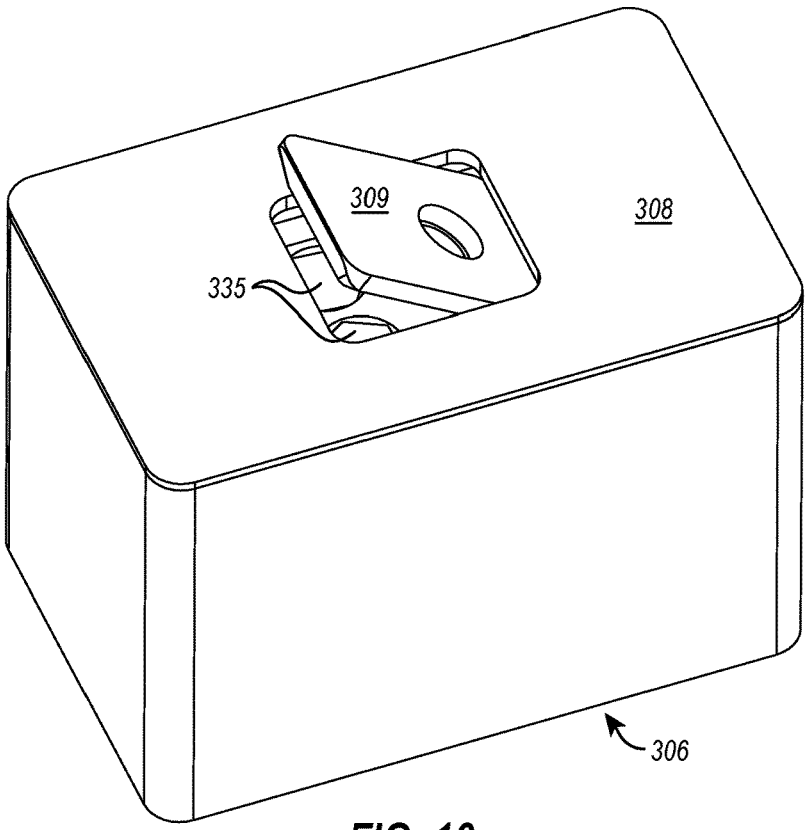
FIG. 16 illustrates the exemplary locking system and housing of FIG. 13 with the inner lid of the housing being opened.

Once the cylindrical lock body is removed, the inner lid 309 can be slid laterally until an edge can be removed through the lid 308 (as shown in FIG. 16). Removal of the inner lid 309 reveals securing member 335 which can now be engaged to loosen the lid 308 from its association with the housing 306. In some embodiments, the inner lid 309 is not removed from the lid 308. Rather, the inner lid 309 is moved laterally and/or pivoted to a position that reveals the securing members and allows them to be accessed and/or engaged for the removal of the lid 308.

Housing Adapters

Figure 17:
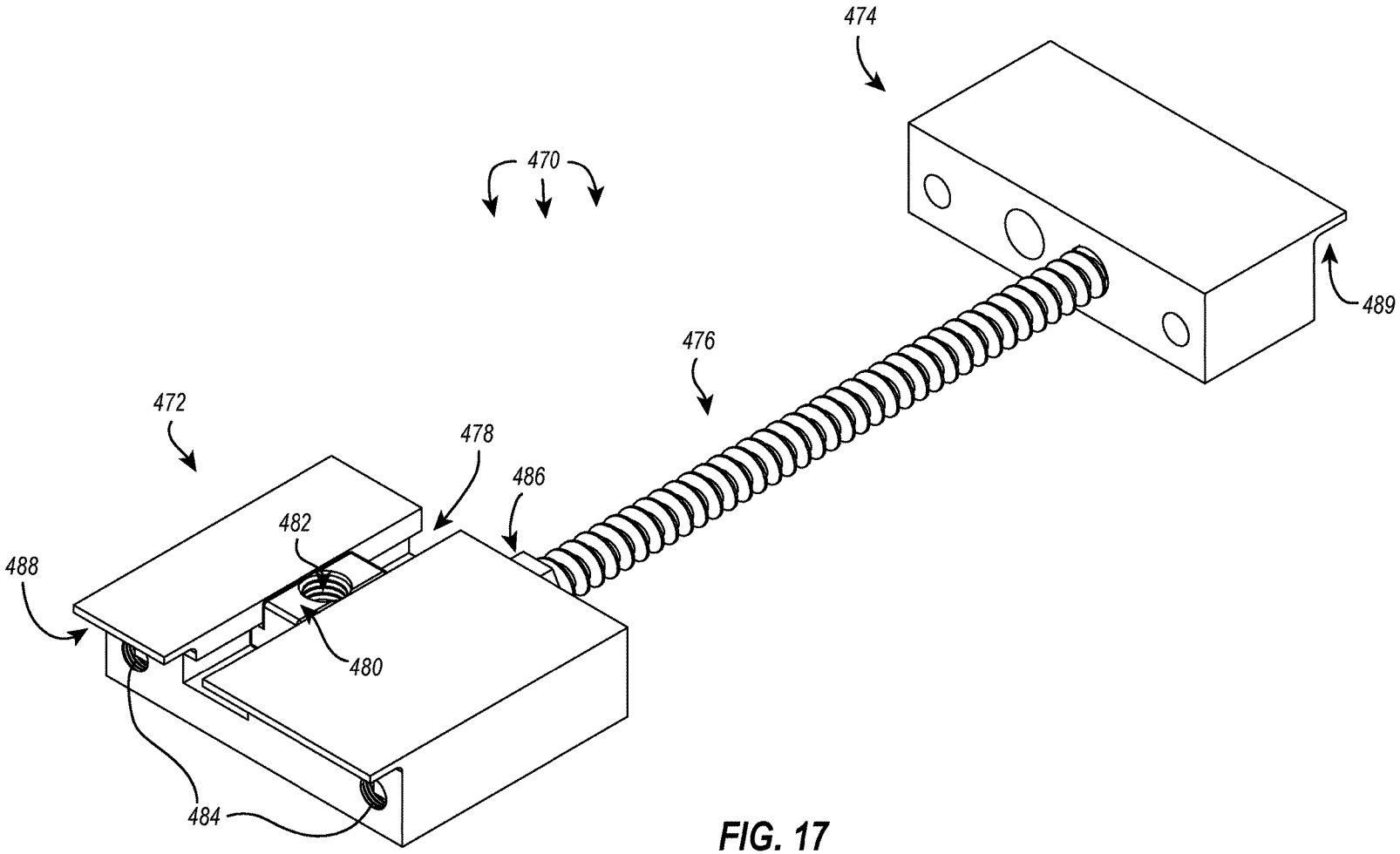
FIG. 17 illustrates an exemplary adjustable adaptor.
Figure 18:
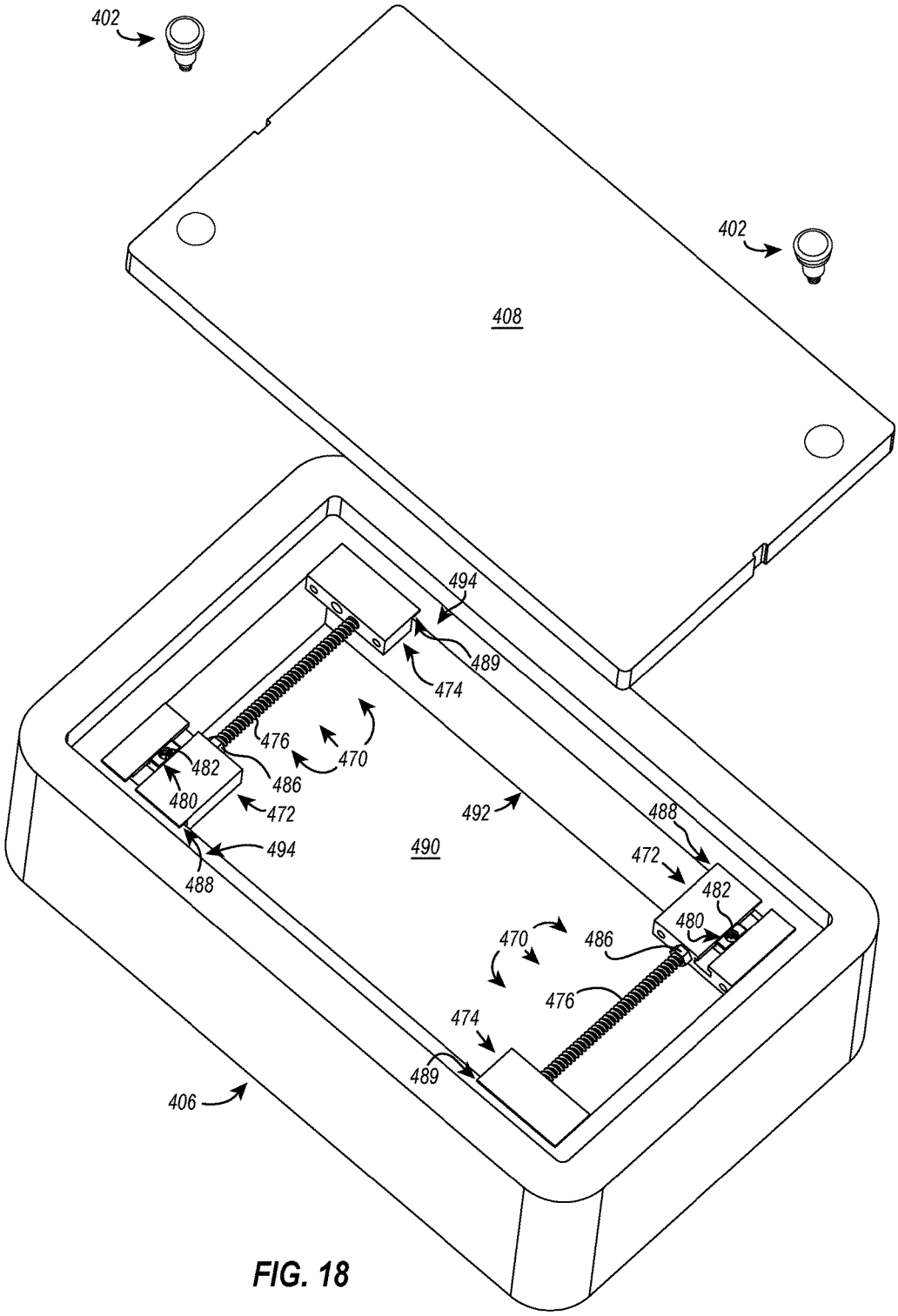
FIG. 18 illustrates a partially exploded view of a locking system and housing that incorporates adjustable adaptors.

In some implementations, particularly those implementations where a housing is retrofit with a locking system disclosed herein, the internal structure of the housing does not have the infrastructure necessary for implementing the locking system, greater versatility is desired when implementing the locking system, and/or additional securing features are desired. As shown in FIGS. 17 and 18, one or more housing adaptors 470 can be implemented within a housing 406 to receive and secure a tamper-resistant lock 402.

As shown in FIG. 17, a housing adapter 470 includes a first end 472 and a second end 474 separated by the first end 472 by an elongate member 476. As further illustrated in FIG. 17, the first end 472 has a channel 478 disposed therein, which can slidably receive a lock coupling member 480 that is sized and shaped to fit within the channel 478. The lock coupling member 480 can include a threaded bore 482 that is configured to, for example, receive external threads of a complementary tamper-resistant lock. In some embodiments, the lock coupling member includes any other attachment mechanism that may selectively secure a complementary tamper-resistant lock. In some embodiments, the channel within the first end additionally includes one or more anchoring members configured to receive a lock anchor that additionally secures a tamper-resistant lock (similar to that described above in FIGS. 13-16).

Also illustrated in FIG. 17, a first end 472 can include one or more selectively extendable rams 484. As illustrated, selectively extendable rams can rotatingly extend from the first end 472. In some embodiments, the selectively extendable rams can ratchet forward or may extend by any other means known in the art. The selectively extendable rams 484 of FIG. 17 are illustrated as having a pointed tip. The pointed tip may be advantageous as it can concentrate the force applied by the ram on a smaller area, which may make it more difficult to dislodge or move the adjustable adaptor 470 when the selectively extendable rams are in contact with an adjacent surface. In some embodiments, the selectively extendable rams include a flat or rounded tip.

It should be appreciated that although FIG. 17 illustrates only the first end 472 as having selectively extendable rams 484, the second end 474 can additionally, or alternatively, include one or more selectively extendable rams.

FIG. 17 illustrates an elongate member 476 that is threadingly received into the first and/or second ends 472, 474 of the adjustable adapter 470. In some embodiments, one of the first or second ends does not move with respect to the elongate member but is fixed on an end thereof. The other, unfixed end can slide and/or rotate along the elongate member to adjust the distance between the first and second ends. In some embodiments, a stopper is provided on the elongate member for fixing a distance between the first and second ends. As shown in FIG. 17, a stopper is a threaded nut 486 that can be rotated along the elongate member 476 to define a distance between the first and second ends 472, 474.

Referring now to FIG. 18, illustrated is an exemplary locking system with adapters 470 placed within an interior portion 490 of housing 406. A flange or lip 488, 489 of the first and second ends 472, 474 rest on an interior ledge 494 of the housing 406, allowing the adjustable adapters 470 to span the width of the interior portion 490 of the housing 406 in to be suspended near the opening of the housing 406. In some embodiments, the distance between the first and second ends of the adjustable adapters is adjusted so that the adjustable adapters can span a length of the housing. In some embodiments, one or more adjustable adapters span a width of the housing and/or one or more adjustable adapters span a length of the housing.

In some embodiments, the housing does not include an interior ledge. In such instances, or at the preference of the user, the adjustable adapters can be placed on the top edge of a sidewall of the housing with the adjustable adapter spanning a length and/or width of the housing.

Once the desired distance between the first and second ends 472, 474 is established, the adjustable rams (not shown in FIG. 18) can be extended to engage the sidewall of the housing (or another comparable component of the housing), thereby securing the adjustable adapter 470 in its selected location. In some embodiments, engaging a housing sidewall with a first selectively extendable ram is sufficient to hold the adjustable adapter in position. In some embodiments, engaging the housing sidewall with a second selectively extendable ram prevents one or more of a rotational, lateral, or vertical movement of the associated end or of the adjustable adapter, generally. In some embodiments, first and second selectively extendable rams are positioned on opposing sides of the first and/or second ends of the adjustable adaptor.

In some embodiments, the adjustable adapters 470 are placed within the interior portion 490 of the housing 406 such that the lock coupling member is substantially aligned with openings in the associated housing lid 408. Accordingly, when the lid 408 is placed on the housing 406, a tamper-resistant lock 402 can secure the lid to the housing 406 by engaging the lock coupling member 480. The tamper-resistant lock 402 can be shaped and/or function in a manner similar to those tamper-resistant locks disclosed above.

In an exemplary implementation, a tamper-resistant lock used with the adjustable adaptors described above includes a split shaft (e.g., as shown and described in FIG. 11). Upon engaging the threaded bore of the lock coupling member, the tamper-resistant lock can be further secured to the adjustable adapter by selectively driving a lock anchor into the split shaft (e.g., through the bore and anchoring member of the cylindrical lock body of the tamper-resistant lock).

It should be appreciated that although the first end of the adjustable adapter is the only end shown as having a lock coupling member, in some embodiments, both the first and second ends include lock coupling members. Additionally, or alternatively, the channels that receive the lock coupling member may be positioned at different angles and/or orientations within the first and/or second ends of the adjustable adapter. In some embodiments, there are multiple channels disposed in one or more orientations within the first and/or second ends of the adjustable adapter.

CONCLUSION

Unless defined otherwise, all technical and scientific terms used herein have the same meaning as commonly understood by one of ordinary skill in the art to which the present disclosure pertains.

Any headings used herein are for organizational purposes only and are not meant to be used to limit the scope of the description or the claims.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A locking system, comprising:

a tamper-resistant lock, comprising:

a cylindrical lock body having external threading on at least a portion of a length of the cylindrical lock body;

a bore extending into an end of the cylindrical lock body, the bore having an engagement feature disposed on a wall defining the bore, the engagement feature being disposed a particular distance away from an opening of the bore; and a bore cap sized and shaped to fit within and occlude the opening of the bore, the bore cap comprising an arcuate head having a flat, continuously smooth top surface and a beveled edge, wherein at least the arcuate head of the bore cap is made of a ferrous material; and a key operable for use with the tamper-resistant lock, comprising:

a collar having a cylindrical key body sized and shaped to be at least partially disposed within the bore;

an opening defined by a sidewall of the collar;

a retractable engagement member at least partially disposed within the opening defined by the sidewall of the collar;

a spring disposed within the collar;

a plunger extending from a proximal end to a distal end, the distal end disposed within the collar and interfacing with the spring and having a recess that is sized and shaped to accommodate the retractable engagement member; and a magnet disposed at the proximal end of the plunger and operable to engage the arcuate head of the bore cap such that a magnetic force between the magnet and the arcuate head of the bore cap is greater than a resistive force retaining the bore cap in association with the cylindrical lock body.

2. The locking system as in claim 1, wherein a cross-section of the opening of the bore forms an uninterrupted circle.

3. The locking system as in claim 1, wherein the engagement feature comprises an elongate ridge extending into the wall defining the bore, the elongate ridge sized and shaped to receive the retractable engagement member.

4. The locking system as in claim 1, further comprising a lock anchor for selectively securing the lock to an anchoring member.

5. The locking system as in claim 4, wherein the lock anchor comprises an attachment mechanism that selectively couples the cylindrical lock body to the anchoring member.

6. The locking system as in claim 5, wherein the attachment mechanism comprises a bolt or a screw that extends through an aperture defined by a bottom of the cylindrical lock body to threadedly engage the anchoring member, wherein a head of the bolt or screw biases the cylindrical lock body toward the anchoring member as the bolt or screw threadedly engages the anchoring member, and wherein the bolt or screw prevents one or more of a lateral, a vertical, or a rotational movement of the cylindrical lock body when the bolt or screw threadedly engages the anchoring member.

7. The locking system as in claim 5, further comprising a second key for selectively coupling the cylindrical lock body to the anchoring member via the attachment mechanism, the second key comprising:

a bit sized and shaped to manipulate the attachment mechanism; and a guide coupled to the bit, the guide sized and shaped to fit at least partially within the bore.

8. The locking system as in claim 4, wherein the bore cap comprises:

a stem coupled to the head and sized and shaped to fit within the bore; and a sealing member disposed on the stem that selectively engages the wall defining the bore when the stem is disposed therein.

9. The locking system as in claim 8, wherein the sealing member is disposed on the stem at a predefined position, the predefined position being located above the engagement feature when the bore cap is secured within the opening of the bore.

10. The locking system as in claim 1, wherein the collar of the key comprises a flange.

11. The locking system as in claim 10, wherein the flange is positioned on the cylindrical key body such that a first length-between a distal end of the collar and the flange—is less than a second length-between the opening of the bore and a surface defining a floor of the bore—such that when the collar is disposed within the bore, the flange contacts the cylindrical lock body before the distal end of the collar contacts the surface defining the floor of the bore.

12. The locking system as in claim 1, wherein the recess in the plunger comprises an annular channel.

13. The locking system as in claim 1, wherein the bore includes a second engagement feature, and wherein the key includes a second retractable engagement member at least partially disposed within a second opening defined by the sidewall of the collar, the second retractable engagement member being positioned such that it engages the second engagement feature when the retractable engagement member engages the engagement feature.

14. A locking system, comprising:

a housing comprising an anchoring member and a lid;

a tamper-resistant lock for securing the lid to the anchoring member, the tamper-resistant lock comprising:

a cylindrical lock body having external threading on at least a portion of a length of the cylindrical lock body, wherein the portion of the cylindrical lock body passes through the lid and is selectively received within the anchoring member; and a bore extending into an end of the cylindrical lock body, the bore having an engagement feature disposed on a wall defining the bore, the engagement feature being disposed a particular distance away from an opening of the bore; and a bore cap sized and shaped to fit within and occlude the opening of the bore, the bore cap comprising an arcuate head having a flat, continuously smooth top surface and a beveled edge, wherein the beveled edge is recessed below a surface of the lid, and wherein at least the arcuate head of the bore cap is made of a ferrous material; and a key, comprising:

a collar having a cylindrical key body sized and shaped to be at least partially disposed within the bore;

an opening defined by a sidewall of the collar;

a retractable engagement member at least partially disposed within the opening;

a spring disposed within the collar;

a plunger extending from a proximal end to a distal end, the distal end disposed within the collar and interfacing with the spring and having a recess that is sized and shaped to accommodate the retractable engagement member; and a magnet disposed at the proximal end of the plunger and operable to engage the arcuate head of the bore cap such that a magnetic force between the magnet and the arcuate head of the bore cap is greater than a resistive force retaining the bore cap in association with the cylindrical lock body.

15. The locking system of claim 14, wherein the beveled edge of the bore cap is recessed below a surface of the lid.

16. The locking system of claim 15, wherein the beveled edge of the bore cap abuts a sidewall of the lid defining a recess in the lid into which the bore cap is recessed below the surface of the lid.

17. The locking system of claim 14, wherein the flat, continuously smooth top surface is co-planar with a surface of the lid when the bore cap is associated with the bore of the cylindrical lock body and the tamper-resistant lock is securing the lid to the anchoring member.

18. The locking system of claim 14, further comprising a lock anchor for selectively securing the cylindrical lock body to the anchoring member.

19. The locking system of claim 18, wherein the lock anchor comprises a bolt or a screw that extends through an aperture defined by a bottom of the cylindrical lock body to threadedly engage the anchoring member, wherein a head of the bolt or screw biases the cylindrical lock body toward the anchoring member as the bolt or screw threadedly engages the anchoring member, and wherein the bolt or screw prevents one or more of a lateral, a vertical, or a rotational movement of the cylindrical lock body when the bolt or screw threadedly engages the anchoring member.

* * * * *